US009752358B2

(12) United States Patent
Powell et al.

(10) Patent No.: US 9,752,358 B2
(45) Date of Patent: Sep. 5, 2017

(54) CARGO DOOR HANDLE

(71) Applicant: AVIATION TECHNICAL SERVICES, INC., Everett, WA (US)

(72) Inventors: Andrew Powell, Mukilteo, WA (US); Larry Coburn, Marysville, WA (US); Antonio Zuniga, Lake Stevens, WA (US); Asia Davis, Edmonds, WA (US)

(73) Assignee: Aviation Technical Service, Inc., Everett, WA (US)

( * ) Notice: Subject to any disclaimer, the term of this patent is extended or adjusted under 35 U.S.C. 154(b) by 170 days.

(21) Appl. No.: 14/720,642

(22) Filed: May 22, 2015

(65) Prior Publication Data

US 2015/0337570 A1 Nov. 26, 2015

Related U.S. Application Data

(60) Provisional application No. 62/002,546, filed on May 23, 2014.

(51) Int. Cl.

| | |
|---|---|
| ***E05B 3/00*** | (2006.01) |
| ***E05B 85/10*** | (2014.01) |
| ***E05B 79/10*** | (2014.01) |
| ***E05B 85/12*** | (2014.01) |
| ***E05B 63/14*** | (2006.01) |

(52) U.S. Cl.

CPC ..... *E05B 85/103* (2013.01); *E05B 63/14* (2013.01); *E05B 79/10* (2013.01); *E05B 85/107* (2013.01); *E05B 85/12* (2013.01); *Y10T 292/57* (2015.04)

(58) Field of Classification Search

CPC .. Y10S 292/31; Y10S 292/49; Y10S 180/904; E05C 19/145; E05C 1/065; E05C 19/14; E05C 1/145; Y10T 292/216; E05B 5/003; E05B 5/00

USPC ..... 292/336.3, DIG. 31

See application file for complete search history.

(56) References Cited

U.S. PATENT DOCUMENTS

| | | | | |
|---|---|---|---|---|
| 3,743,336 A * | 7/1973 | Andrews | ..... | E05C 1/145 292/173 |
| 5,620,212 A * | 4/1997 | Bourne | ..... | B64D 29/06 292/113 |
| 8,740,147 B2 * | 6/2014 | Defrance | ..... | B64D 29/06 244/129.4 |

* cited by examiner

*Primary Examiner* — Mark Williams

(74) *Attorney, Agent, or Firm* — LaRiviere, Grubman PC

(57) ABSTRACT

A flush door latch assembly used to secure a hinged aircraft access door. The assembly comprises a spring-loaded exterior handle, an actuator, an interior handle, and housing pan. During operation, the handles alternatively engage the actuator. When the exterior handle is in the retracted position, it disengages from the actuator. When the exterior handle is in the extended position, the interior handle is disengaged from the actuator. When the exterior handle is in the retracted position, it is stowed in the housing pan.

6 Claims, 20 Drawing Sheets

Actuator 17 shown in transparent and other components shown in contrasting colors to help with identification

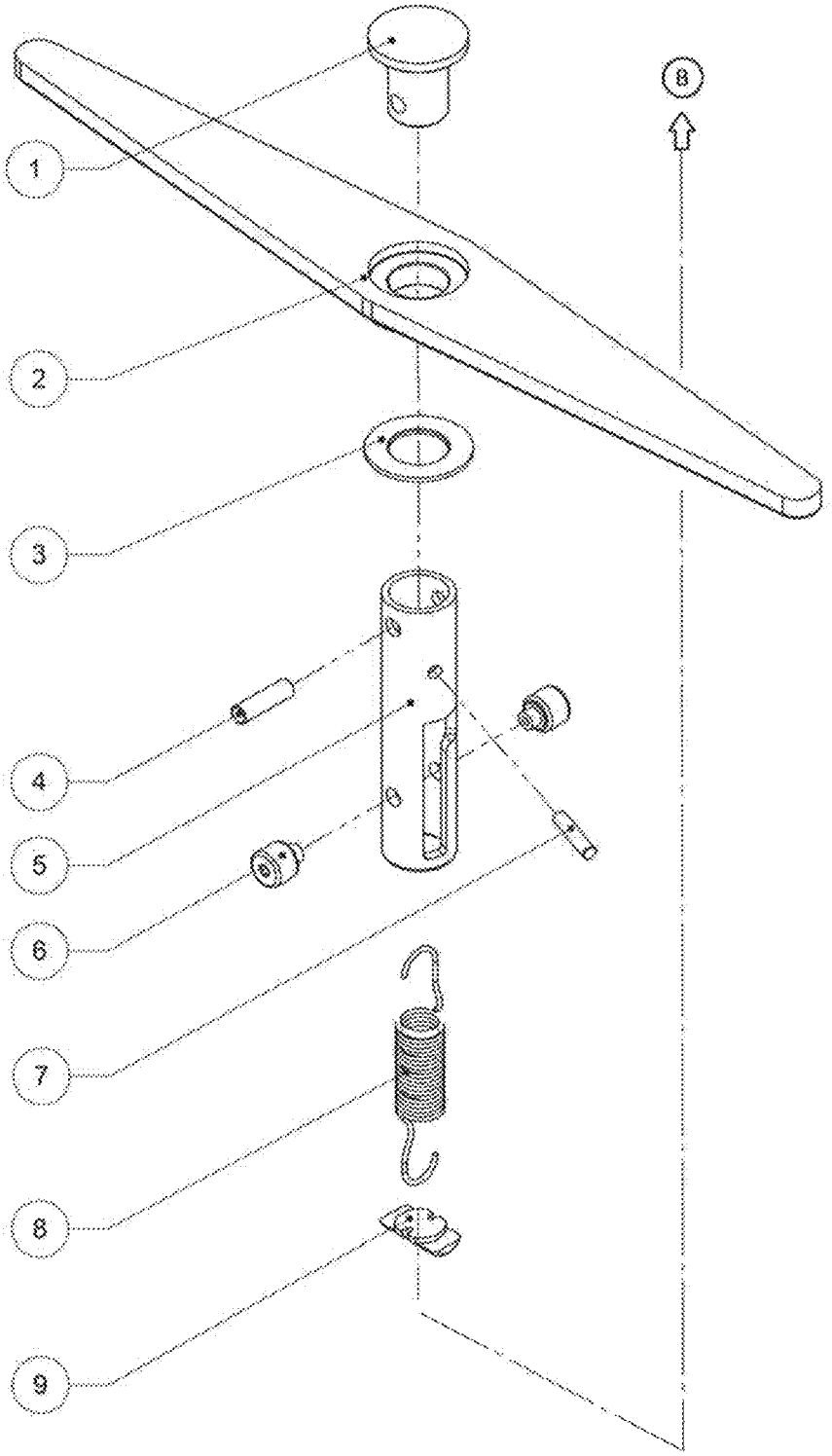
FIGURE 8a: Flush Door Latch Assembly

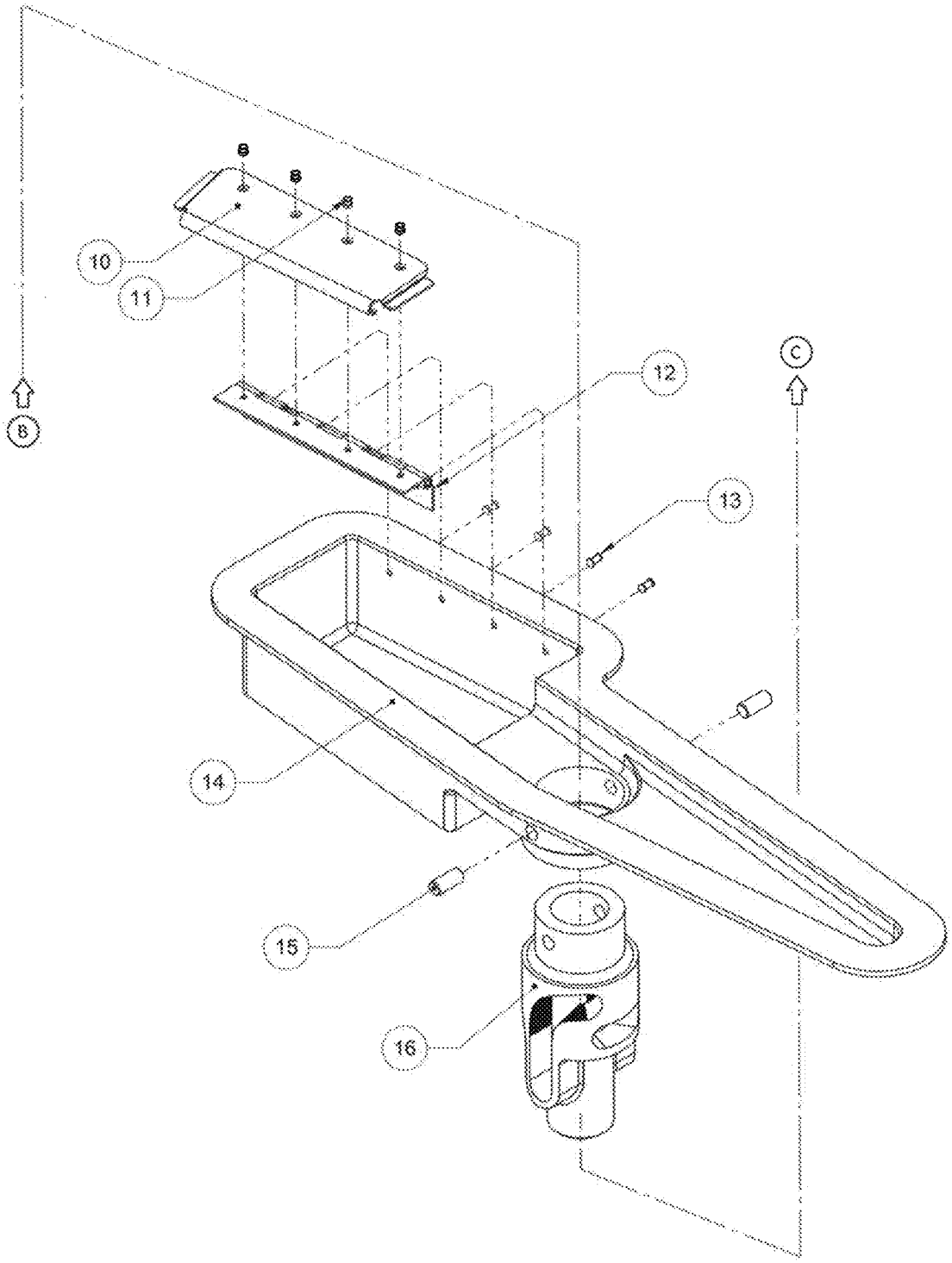
FIGURE 8B: Flush Door Latch Assembly

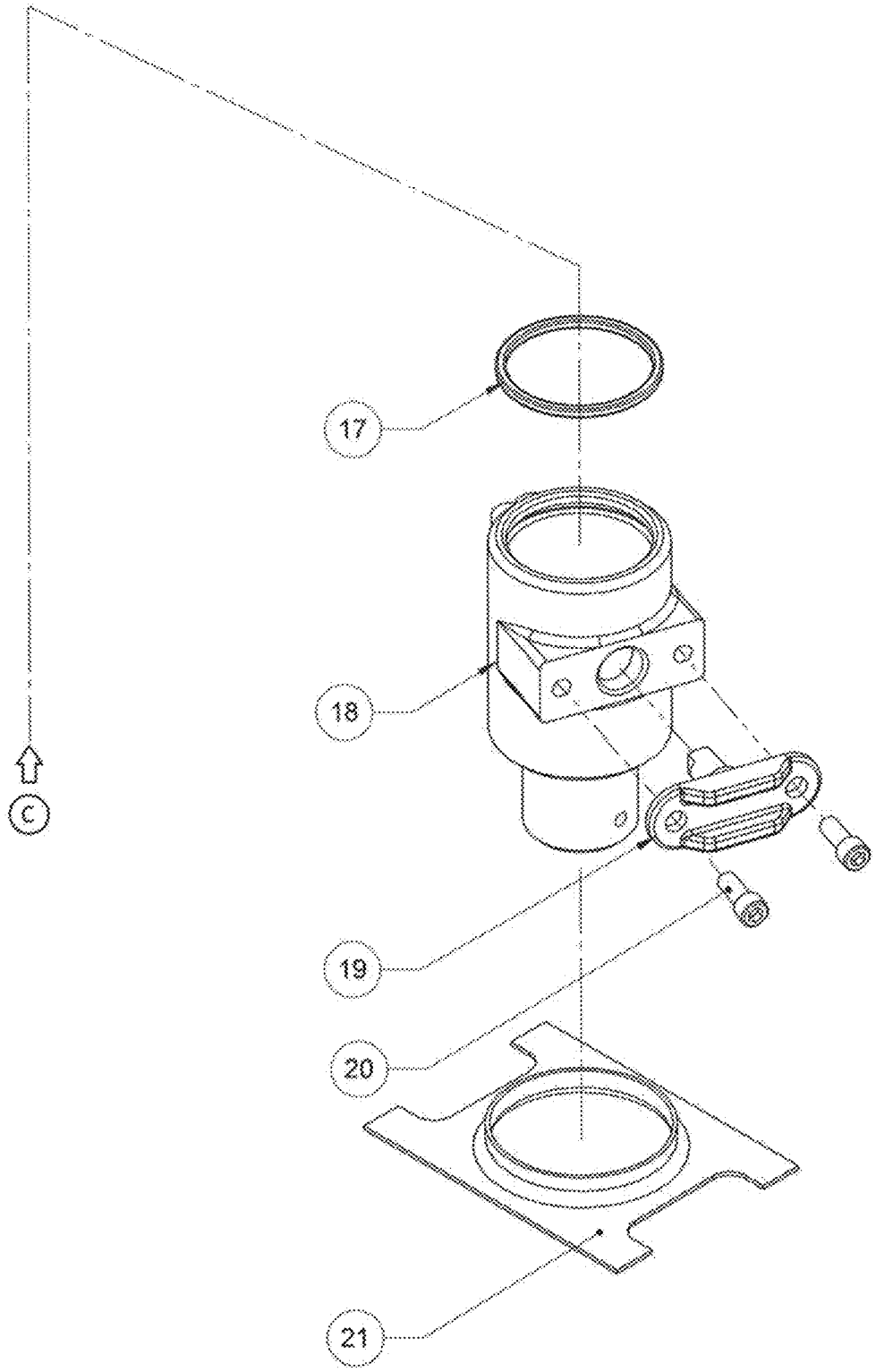
FIGURE 8C: Flush Door Latch Assembly

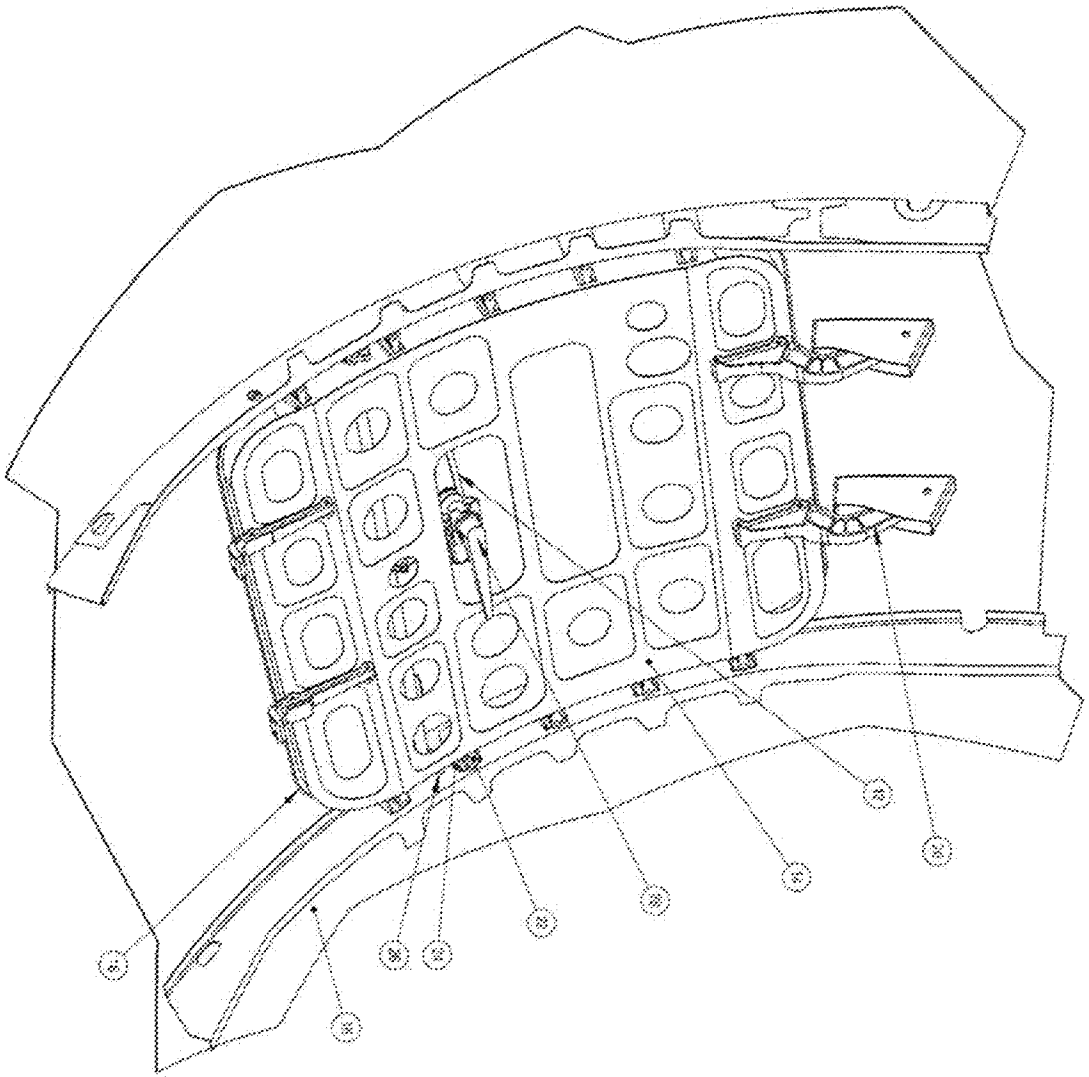
FIGURE 9: Interior Side of the Cargo Door

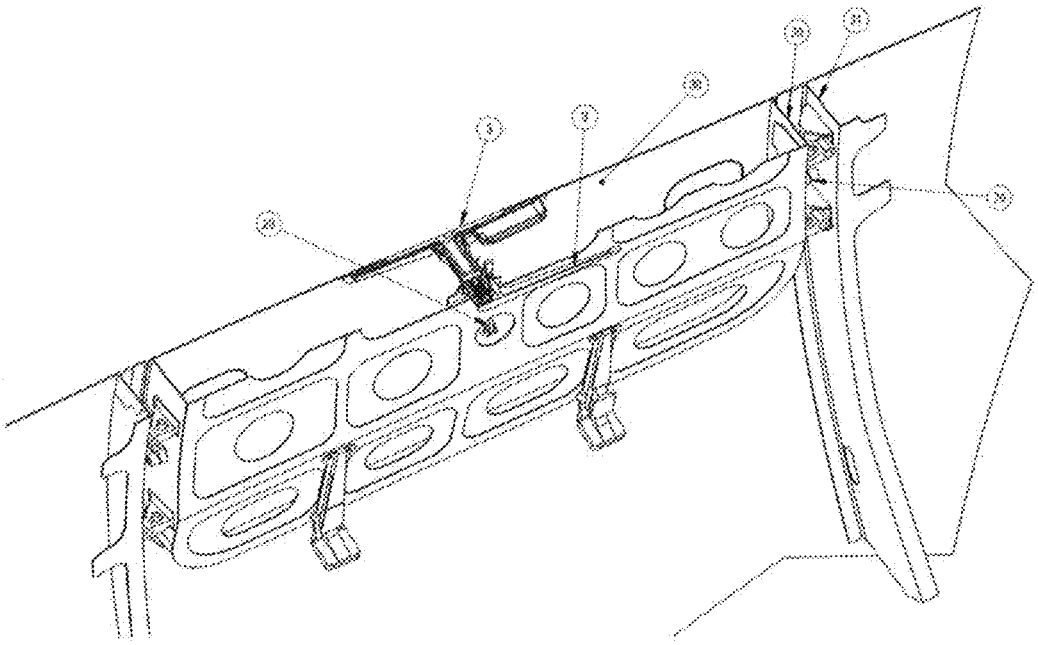
Figure 10: cross section of latch assembly installed on door
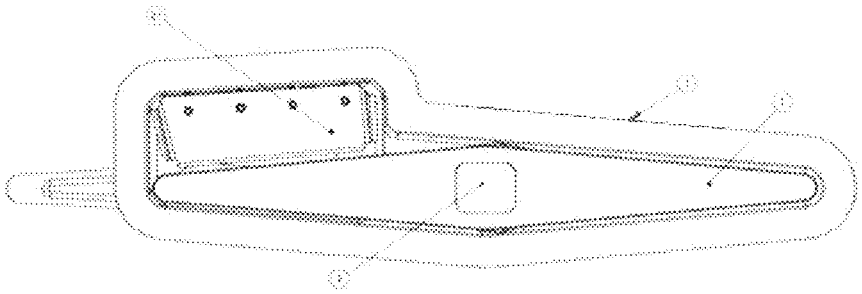
FIGURE 11: Look at the handle assembly normal to the exterior face

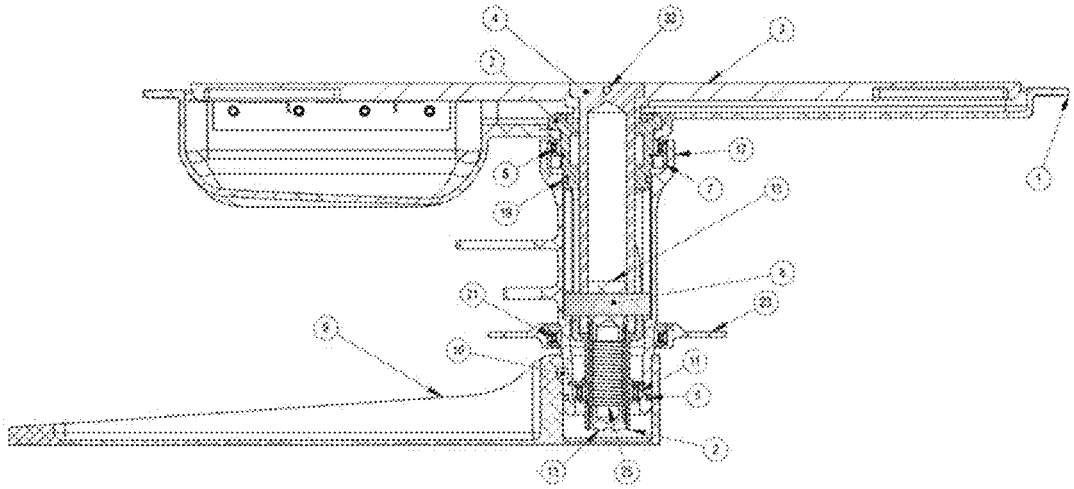
FIGURE 12: Looking at cross section E-E taken from Figure 11

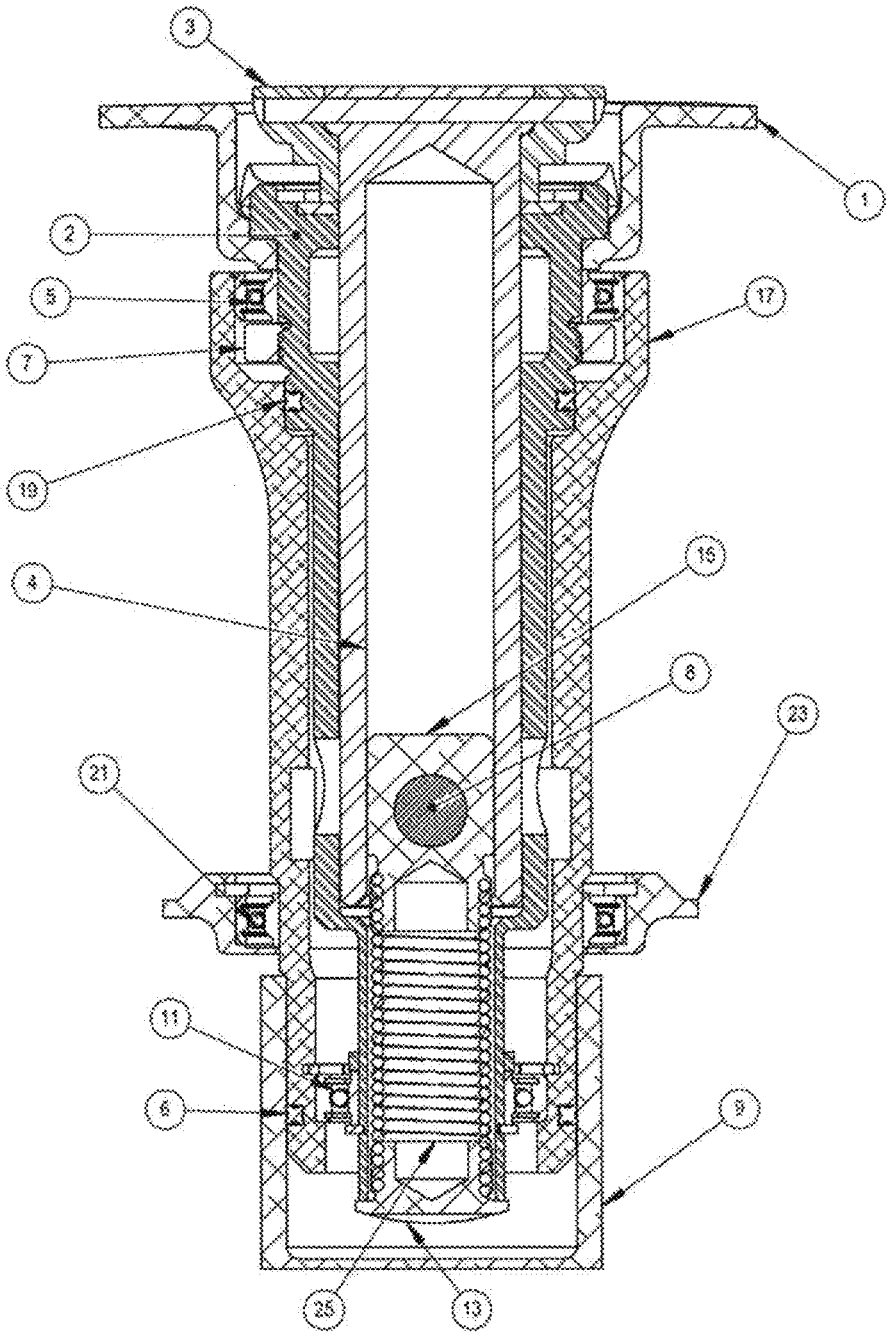
FIGURE 13: Look at cross section G-G taken from Figure 11

FIGURE 14a: Actuator 17 shown in transparent and other components shown in contrasting colors to help with identification

FIGURE 14b: Actuator 17 shown in transparent and other components shown in different colors to help with identification. Also, the external handle 3 is cut away for view clarity

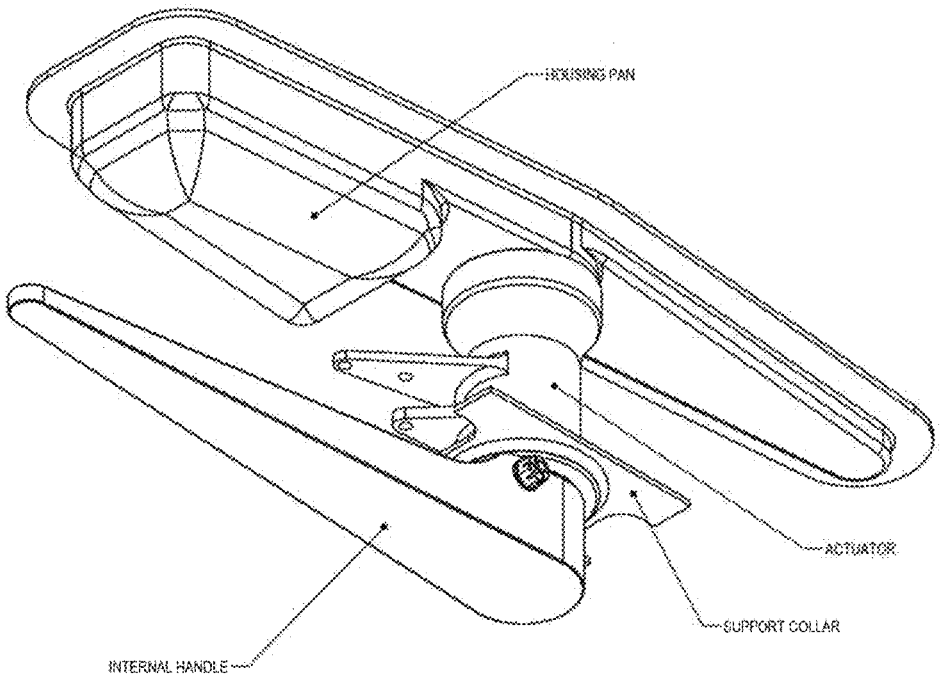
Figure 15a: Primary Components
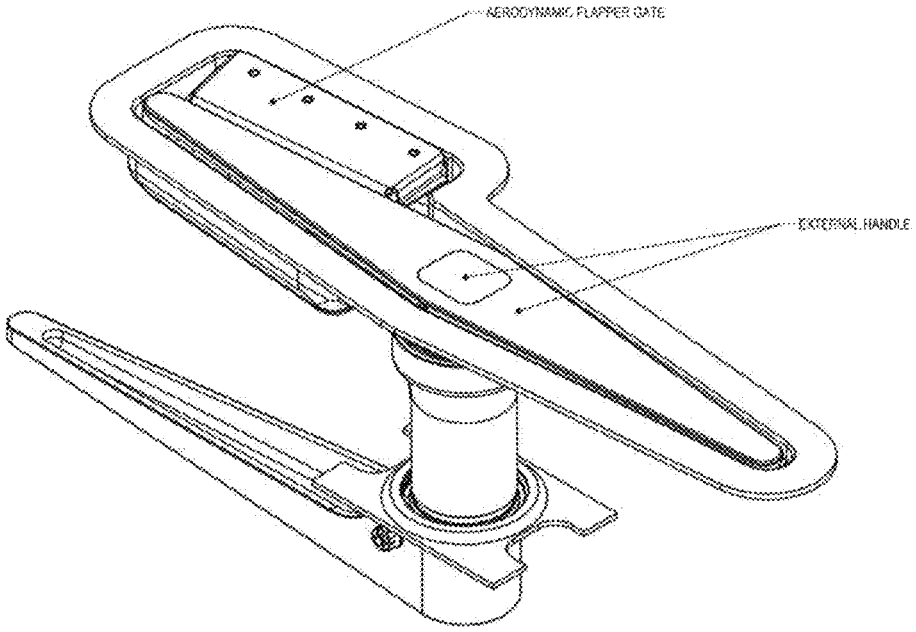
Figure 15b: Primary Components

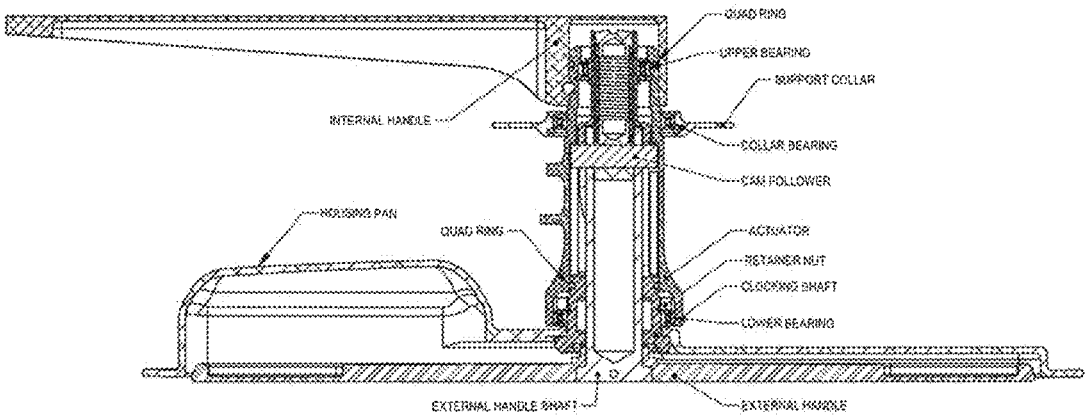
Figure 16: Cross Section View

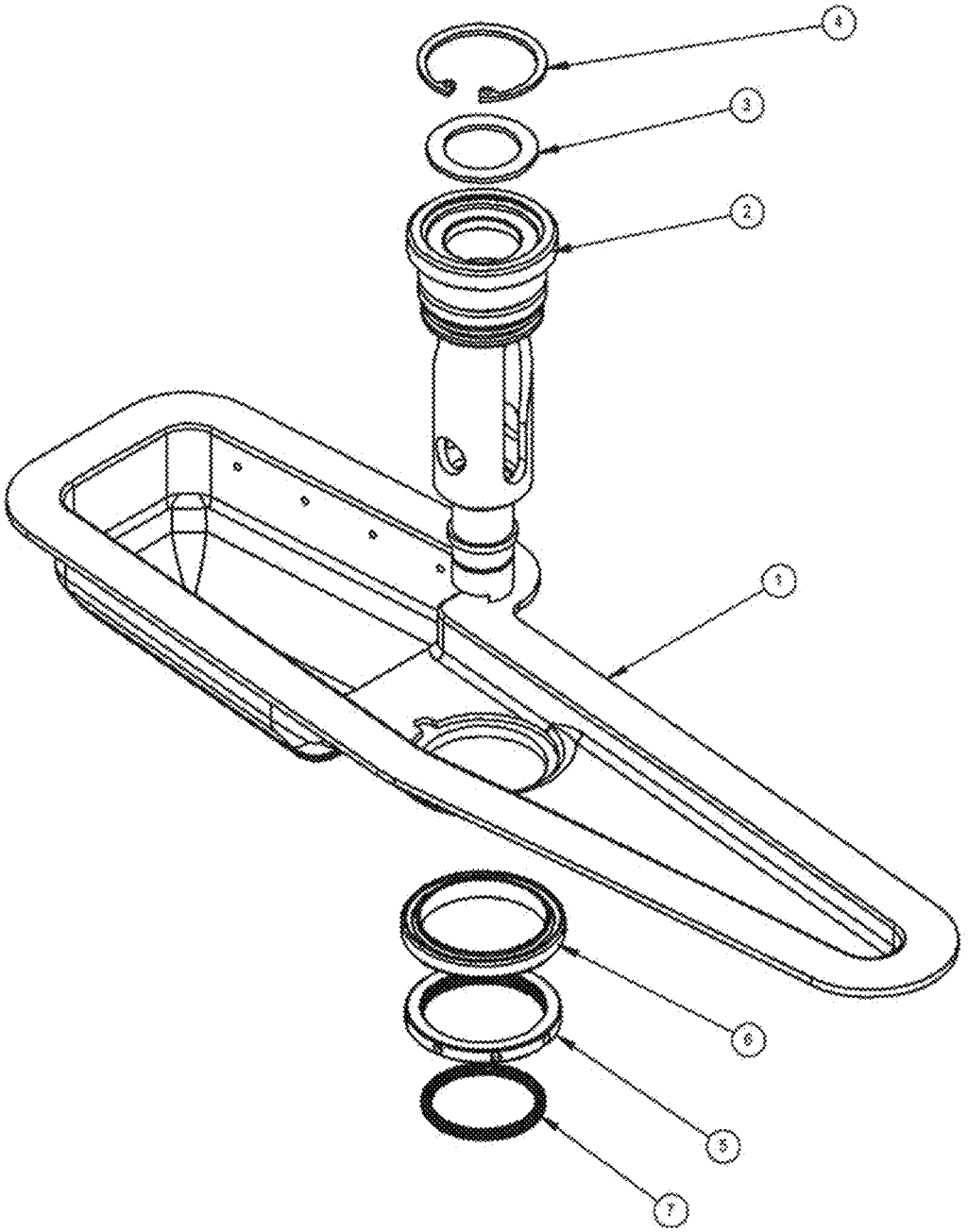
FIGURE 17a: Flush Door Latch Assembly

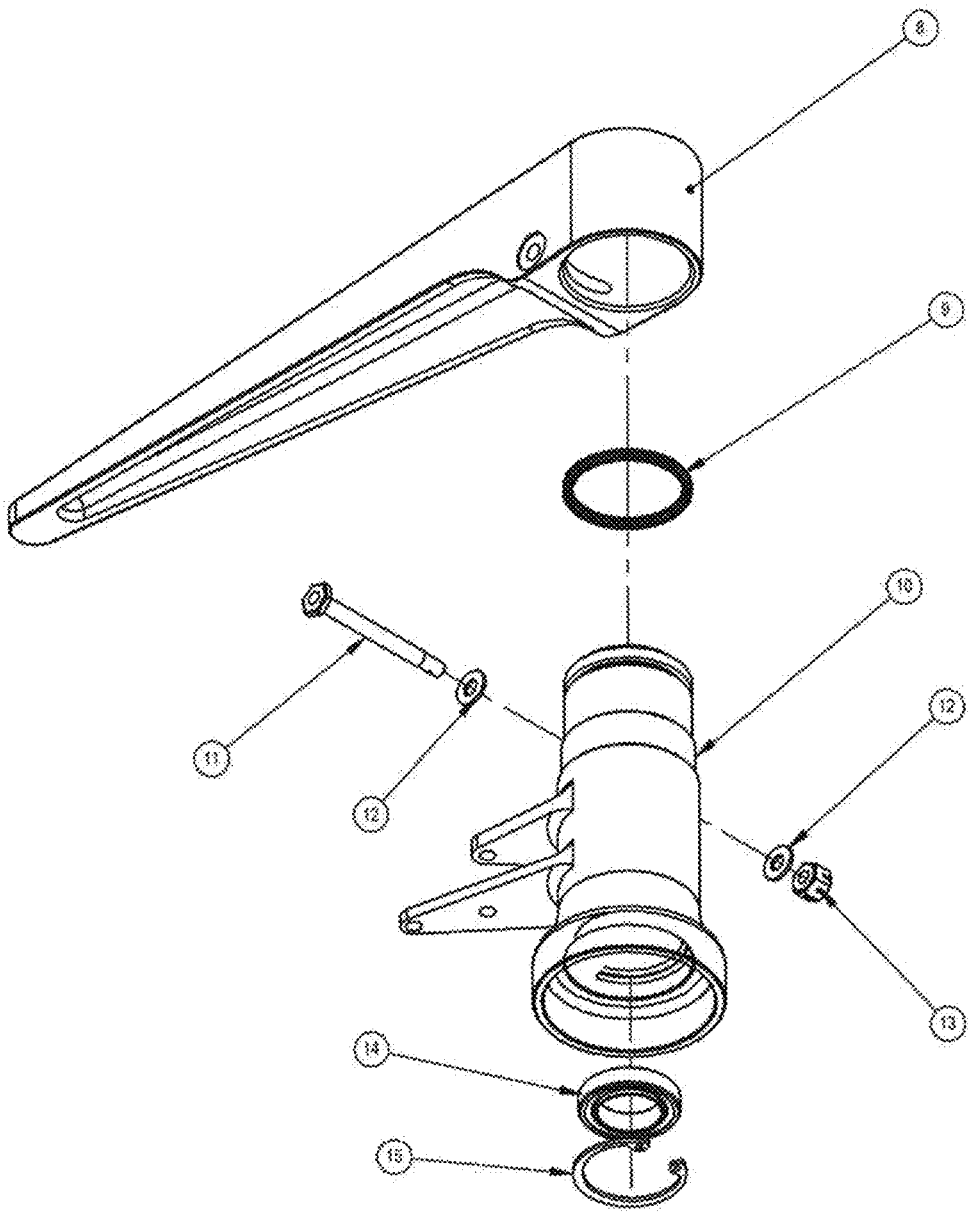
IPL FIGURE 17b: Flush Door Latch Assembly

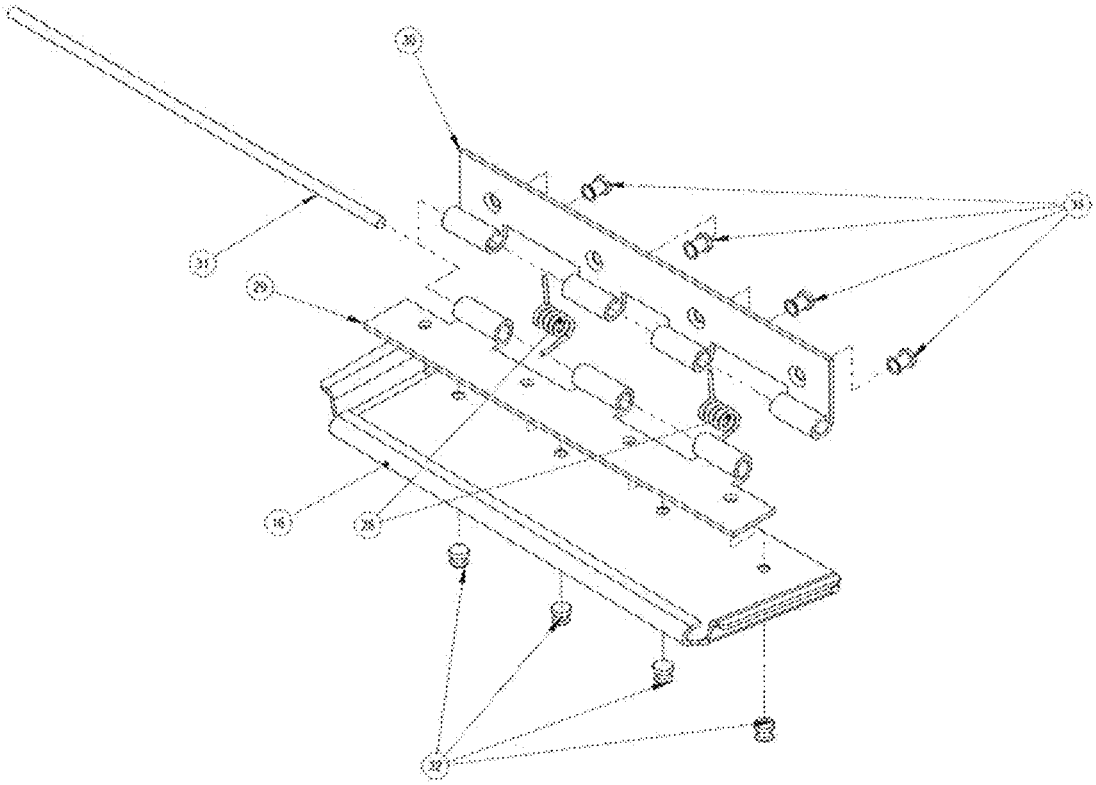
IPL FIGURE 17c: Flush Door Latch Assembly

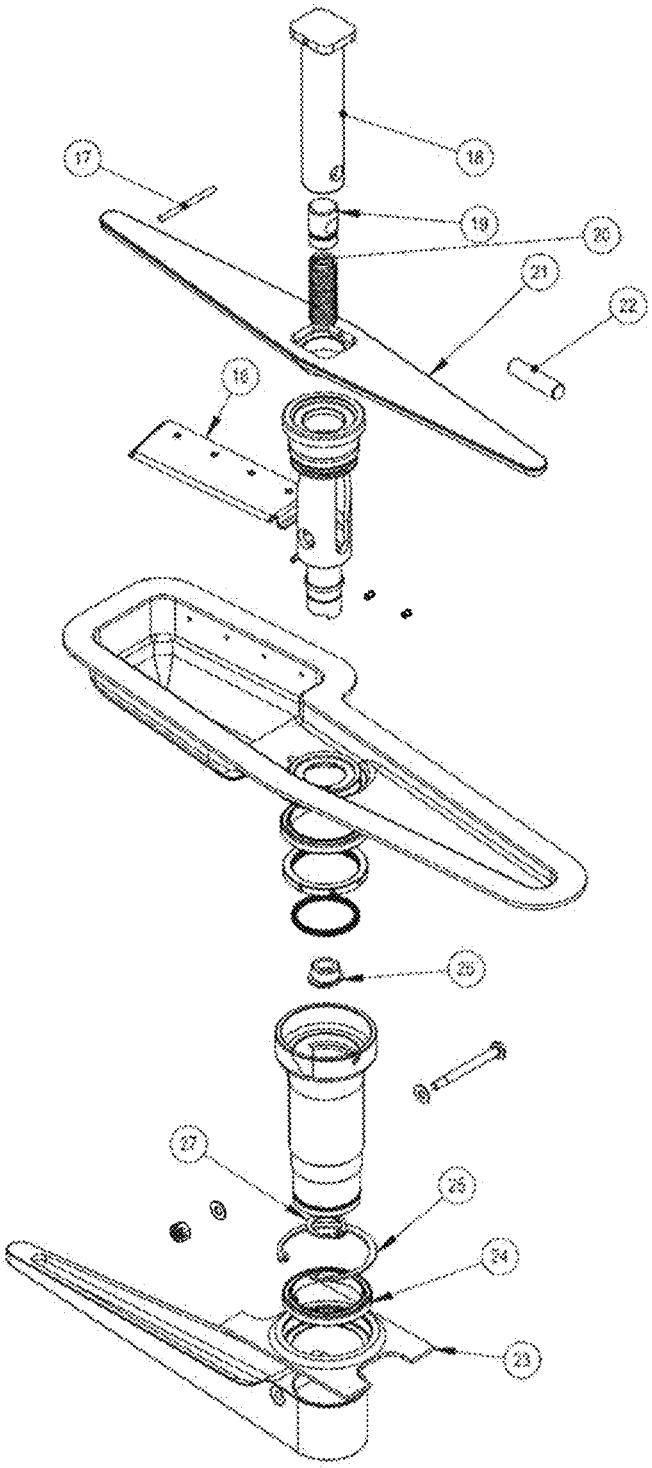
IPL FIGURE 17d: Flush Door Latch Assembly

CARGO DOOR HANDLE

PRIORITY CLAIM

This non-provisional application claims priority to Provisional Patent Application Ser. No. 62/002,546, entitled "Cargo Door Handle", filed on May 23, 2014.

TECHNICAL FIELD

The present invention relates to door handle assemblies and, more particularly, to flush door handle assemblies for controlling the opening and closing of aircraft access doors.

BACKGROUND OF THE INVENTION

An integral part of an aircraft fuselage is the cargo door assembly through which cargo is loaded to and unloaded from the aircraft. The door assemblies of modern commercial aircraft include latch mechanisms that lock the door in place when it is closed and unlock the door when it is opened. The actual opening and closing of the door assemblies are controlled by handle assemblies that actuate the latch mechanisms. Most of the handle assemblies are provided with interior and exterior handles so that the door assemblies in which they are installed may be opened or closed from either inside or outside the aircraft.

An aircraft door handle assembly is typically designed to perform a number of different functions and to operate properly regardless of the harshness of the environmental conditions to which it may be exposed. Most handle assemblies are constructed so that either the interior or exterior handle can be used to actuate the latching mechanism regardless of which handle was last used to actuate the mechanism. This is primarily a safety feature to allow a cargo handler to open the door from the inside of the cargo hold in case the door was closed while the handler was still inside the cargo hold.

The typical handle assembly includes an exterior, or outside handle that is normally stored flush with the outer skin of the aircraft so as to not degrade the aerodynamic efficiency of the fuselage. The handle assembly must keep the outside handle locked in place so that it does not "pop out" in flight regardless of the large pressure differentials that may develop between the inside of the aircraft, which is pressurized, and the outside low ambient pressure at high altitudes. Inadvertent extension of the outside handle can disrupt the airflow around the aircraft and degrade aerodynamic performance. Moreover, extension of the outside handle could lead to its movement so as to cause self-actuation of the handle assembly and the associated latch mechanism. With an unpressurized cabin this could result in the door inadvertently opening while the aircraft is in flight. Moreover, a handle assembly must also be designed to operate even though its exterior components may be exposed to significant amounts of rain or snow.

Aircraft door handle assemblies have been provided that meet one or more of these design criteria. Some aircraft door handle assemblies are constructed so that they are integrally connected to the doors in which they are employed. In the event the handle assembly requires extensive maintenance, the assembly cannot be simply replaced; the whole aircraft must be taken out of service.

In light of the shortcomings in the prior art, there exists a need for an improved door handle assembly for controlling the opening and closing of an aircraft door.

SUMMARY OF THE INVENTION

This invention relates generally to a handle assembly for controlling the opening and closing of an aircraft door. More particularly, this invention is directed to a door handle assembly with three overlapping concentric shafts. The inner shaft is telescoping and connected to an exterior handle. The outer shaft is connected to an interior handle. A cylindrical shaft attached to a housing body is nestled between the outer and inner shafts thereby acting as an intermediate shaft between the inner and outer shaft. The outer shaft connected to the inside handle is axially fixed and is connected to the door latch mechanism so as to control the opening and closing of the aircraft door. The shaft associated with the exterior handle telescopes away from the outer shaft and interlocks with that shaft for rotation only when the exterior handle is extended by a specific distance.

The handle assembly of a one embodiment of this invention includes an inner shaft that is attached to an exterior handle that is normally flush with the outer skin of the aircraft. An outer shaft is disposed completely around an intermediate shaft that is disposed around the inner shaft. The outer shaft has an exposed end, to which an interior handle and a linkage for actuating the door latch mechanism are attached. The inner shaft has an axial slot with a circumferential slot adjoined to one end of the axial slot. The outer shaft has a hole normal to its outer surface passing through its side from its outer diameter through to its inner diameter. A stop pin fitting is fixed to the outer shaft and also passes through the outer and intermediate shaft nestled between the inner and outer shaft so that the pin engages the axial slot of the inner shaft.

Alternatively, the inner shaft has a hole that is perpendicular to the inner shafts cylindrical axis. This hole passes through the entire inner shaft providing support to a cam follower pin. The intermediate shaft has a uniquely shaped slot which allows the cam follower pin to pass thought the intermediate shaft and allow the cam follower pin to engage and disengage the outer shaft depending on the position of the inner shaft. The outer shaft has two channels cut on the inside surface of it running parallel to its axis. These channels have a slightly larger width than the cam follower pin. The channels run completely out one end of the shaft on the same end, the other end of the channels end at a specified distance and intersect another set of channels that runs radially around the axis of the shaft. These radial channels run a specified degrees (about one third the circumference of the outer shaft diameter).

When an aircraft door with which this invention is used is opened or closed from the inside, the interior handle is used to rotate the outer shaft in order to actuate the latch mechanism. The rotation to open or close the door is allowed by the pin fixed to the outer shaft rotating freely within the inner shaft's circumferential slot. The pin is free to rotate in this circumferential slot only when the exterior handle is retracted to its stored position; thereby allowing the interior handle to rotate independently of the exterior handle to open and close the door. Alternatively, the rotation to open or close the door is allowed by the cam follower pin fixed to the inner shaft moving freely in the radial channel of the outer shaft therefore allowing the outer shaft and the interior handle to rotate freely. The cam follower pin is free to rotate in this radial channel only when the exterior handle is retracted to its stored position; thereby allowing the interior handle to rotate independently of the exterior handle to open and close the door.

When the exterior handle is used to open or close the door, the handle is initially pulled away from the aircraft. In one embodiment, this movement extends the inner shaft so that the pin fixed to the outer shaft is captured only by the axial portion of the slot on the inner shaft so as to cause the inner and outer shafts to rotate in unison. The exterior handle can then be turned so as to cause rotation of the shafts and actuation of the latch mechanism. The amount of rotation and the amount of axial extension of the exterior handle before rotation can occur is controlled by the interaction of pin shafts that are attached to the inner shaft with each pin having integral bearings that are in contact with the curved slots in the cylindrical housing body that is nestled between the outer and inner shaft. In another embodiment, this movement extends the inner shaft so that the cam follower pin fixed to the inner shaft is engaged only by the axial portion of the channel in the outer shaft so as to cause the inner and outer shafts to rotate in unison. The exterior handle can then be turned so as to cause rotation of the shafts and actuation of the latch mechanism. The amount of rotation and the amount of axial extension of the exterior handle before rotation can occur is controlled by the interaction of the cam follower pin and the uniquely shaped slot on the intermediate shaft. This slot is shaped in such a way that as the exterior handle (which is fixed to the inner shaft) is extended away from the aircraft skin it cannot rotate until it is a specified distance away from the aircraft skin. Once the external handle is extended past this specified distance the limit of rotation continues to increase until its full limit. With the external handle in the fully extended position the operator can rotate the handle from its lowest limit to its highest limit of rotation.

The door handle assembly of this invention can be used to open or close an aircraft door regardless of which handle was last used to set the door state. While the door handle assembly of this invention can perform these functions, it is constructed out of relatively few parts. The only components that move are those attached to the inner and outer shafts. As a result, this door handle assembly is relatively inexpensive to manufacture. Also, given the limited number of components, the assembly is relatively easy to install and maintain. Still another advantage of this handle assembly is that its components do not significantly add to the overall weight of the aircraft in which it is employed. Notably, the overall weight of this assembly is less than the weight of the original latch assembly.

Moreover, the components that form the door handle assembly of this invention are essentially all contained in the outer shaft or attached to the exterior handle. The assembly can be fitted into a small handle box that is mounted to the aircraft. If the assembly requires extensive maintenance, it can readily be removed from an aircraft and a replacement assembly substituted therefore. Thus, an aircraft only need be taken out of service for a minimal amount of time should it become necessary to work on the outdoor handle assembly of this invention.

Another aspect of the present invention is a flush door latch assembly used to secure a hinged aircraft access door having exterior and interior sides, said latch assembly comprising an actuator; a spring-loaded rotatable exterior handle assembly, having an extended position and a retracted position, the exterior handle assembly engaging the actuator in the extended position and disengaging from the actuator in the retracted position from the exterior side of the access door; a housing pan, disposed around the exterior handle and fixedly mounted to the aircraft access door, and having a recess to receive and stow the exterior handle in its retracted position; and a rotatable interior handle fixedly connected to the actuator to actuate the latch assembly from the interior side of the access door.

Consequently, for a better understanding of the present invention, its functional advantages and the specific objects attained by its uses, reference should be made to the accompanying drawings, claims and descriptive matter in which there are illustrated preferred embodiments of the invention.

BRIEF DESCRIPTION OF THE DRAWINGS

FIG. 8*a* illustrates a perspective view of the Flush Door Latch Assembly.

FIG. 8*b* illustrates another perspective view of the Flush Door Latch Assembly.

FIG. 8*c* illustrates a further perspective view of the Flush Door Latch Assembly.

FIG. 9 illustrates a perspective view of an aircraft door assembly to which one embodiment of a handle assembly of this invention is attached.

FIG. 10 illustrates a perspective view in partial cutaway showing the handle assembly of this invention installed into an aircraft door when viewed from the inside.

FIG. 11 illustrates a top view of the handle assembly as viewed if installed, to the aircraft door looking normal to the outside of the door.

FIG. 12 illustrates a cross-sectional view of the aircraft door assembly of this invention illustrating the view noted in FIG. 11 when the outside handle is stowed.

FIG. 13 illustrates a cross-sectional view of the aircraft door assembly of this invention illustrating the view noted in FIG. 11 when the outside handle is stowed.

FIG. 15*a* illustrates a perspective view showing the primary components of the flush door latch assembly.

FIG. 15*b* illustrates another perspective view showing the primary components of the flush door latch assembly.

FIG. 16 illustrates a cross section view of the flush door latch assembly.

See FIG. 17*a* is a perspective view of the flush door latch assembly.

See FIG. 17*b* is another perspective view of the flush door latch assembly.

See FIG. 17*c* is a further perspective view of the flush door latch assembly.

See FIG. 17*d* is a further perspective view of the flush door latch assembly.

DETAILED DESCRIPTION OF THE FIRST EMBODIMENT OF THE INVENTION

The following detailed description is one embodiment of the current invention. The description is not to be taken in a limiting sense, but is made for at least the purpose of illustrating the general principles of the invention, since the scope of the invention is best defined by the appended claims.

In the first embodiment of invention, a door handle assembly is used to control the latch mechanism of an aircraft door so that the door can be opened or closed from either the inside or outside the aircraft. The door handle assembly includes an outer shaft assembly that is connected to the latch mechanism so as to control the opening and closing of the door, an inner shaft assembly that is overlapped by a housing body and cylindrical housing shaft assembly on whose outer diameter the outer shaft assembly rotates. The cylindrical housing shaft has curved slots that control the motion of the inner shaft assembly so that the inner shaft assembly can only be rotated after it is telescopically extended outward from the cylindrical housing shaft by a fixed amount. Further, an interior handle is attached to the outer shaft assembly so as to rotate the outer shaft assembly. The interior handle is also referred to as the internal handle or the inside handle.

In a typical embodiment, the door handle assembly is provisioned to accept an interior handle provided by an installer of door handle assembly. Rotation of the inner shaft assembly is controlled by an exterior handle assembly attached thereto. The inner shaft assembly and outer shaft assembly are connected by a stop pin fitting that is attached to the outer body of the outer shaft assembly and passes through the cylindrical housing shaft into an axial slot feature of the inner shaft. The axial slot of the inner shaft is terminated by a circumferential slot feature. When the exterior handle is extended, its motion is positively controlled by two pin shafts mounted to it with each pin shaft having an integral bearing that follow the path of the slots in the cylindrical housing shaft. The exterior handle can rotate the outer shaft assembly and interior handle by its connection to the inner shaft assembly and stop pin fitting that is fixed to the outer shaft assembly.

Figure 1:
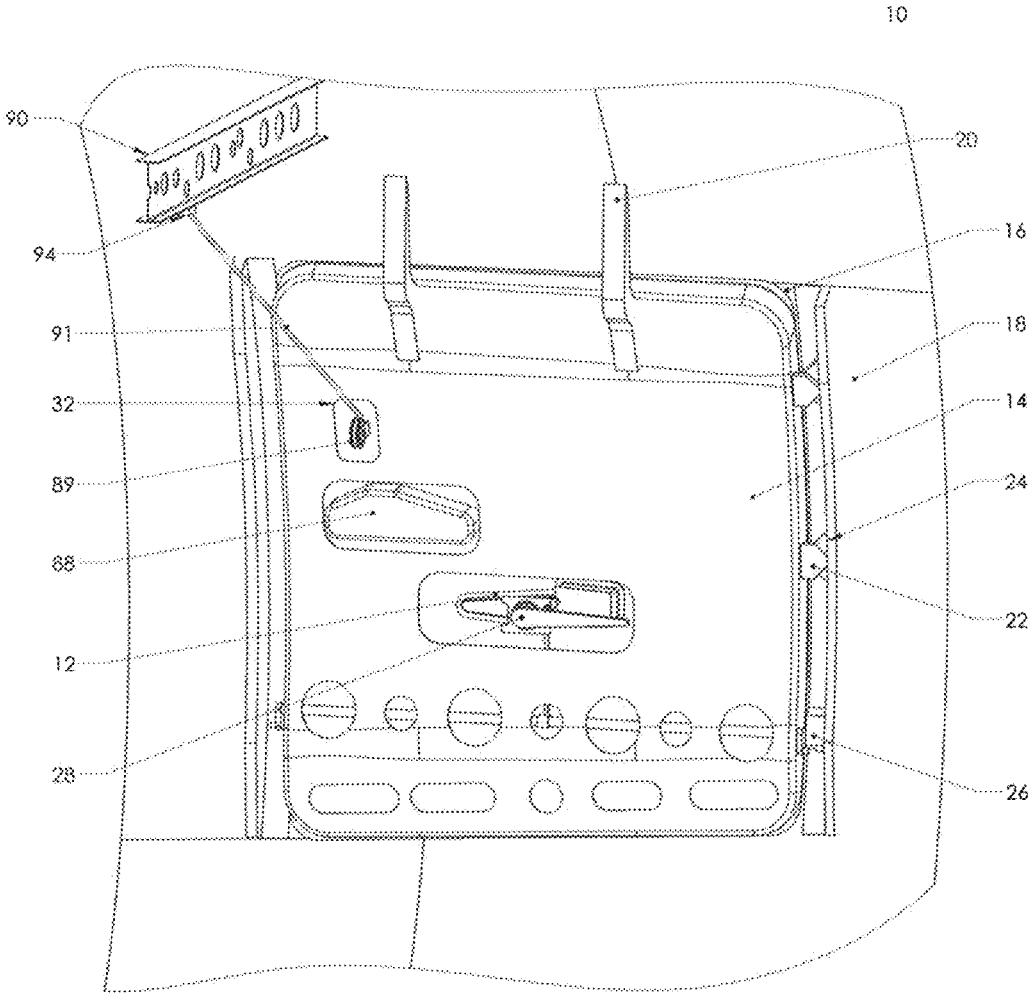
FIG. 1 is a perspective view showing the inside of an aircraft door assembly in which the door handle assembly of this invention is employed.

Referring now to the drawings, FIG. 1 is a perspective view of an aircraft door assembly 10 to which one embodiment of a handle assembly 12 of this invention is attached. The door assembly 10 includes a door 14 fitted into an opening 16 formed inside an aircraft fuselage 18. A hinge 20 connects the door 14 to the inside of the fuselage 18 so that the door can move between open and closed positions. The sides of the door 14 are provided with a number of outwardly extending door stops 22, and the fuselage 18 is provided with a number of flanges 24 that project into the opening 16 adjacent the door stops. When the aircraft is in flight, high cabin pressure inside the fuselage 18, in comparison to lower atmospheric pressure urges the door 14 outwards so that door stops 22 abut the fuselage flanges 24 and seals the door shut. The opening and closing of the door 14 is controlled by a roller cam and track mechanism 26. When the door 14 is closed, the roller cam and track mechanism 26 controls the travel of the door so that the door stops 22 move into a position slightly below and in front of the fuselage flanges 24. After the door stops are adjacent to the fuselage flanges 24, the roller cam and track mechanism pulls the door 14 outwards towards the aircraft fuselage 18 so that the door stops on the fuselage stops. When the door 14 is opened, the roller cam and track mechanism 26 first lifts the door upwards slightly and inwards so that the door stops 22 clear the fuselage flanges 24 so that in turn, the door 16 can be moved upwards to the full open position. The upwards movement of the door 14 to its open position is assisted by a spring loaded counterbalance mechanism 88 that pulls the door upwards. The actuation of the roller cam and track mechanism 26 is controlled by the handle assembly 12 as will be described hereinafter. The handle assembly 12 is typically provisioned to accept the attachment of an inside handle 28 so that actuation of the roller cam and track mechanism 26 and the opening and closing of the aircraft door 14 can be controlled from inside the aircraft.

The counterbalance mechanism 88 comprises a pulley and cable assembly 32 that has the pulley 89 spring loaded and fixed to the door 14. The pulley 89 is connected to the fuselage floor beam 90 by a steel cable 91. When the roller cam and track mechanism 26 releases the door from the closed position, the force of the spring loaded pulley 32 acts on the pulley cable 91. The pulley cable 91 reacts to pull the door upwards and inwards towards the fuselage floor beam 90 until the door rests on a stop pad 94 attached to the fuselage floor beam 90.

Figure 2:
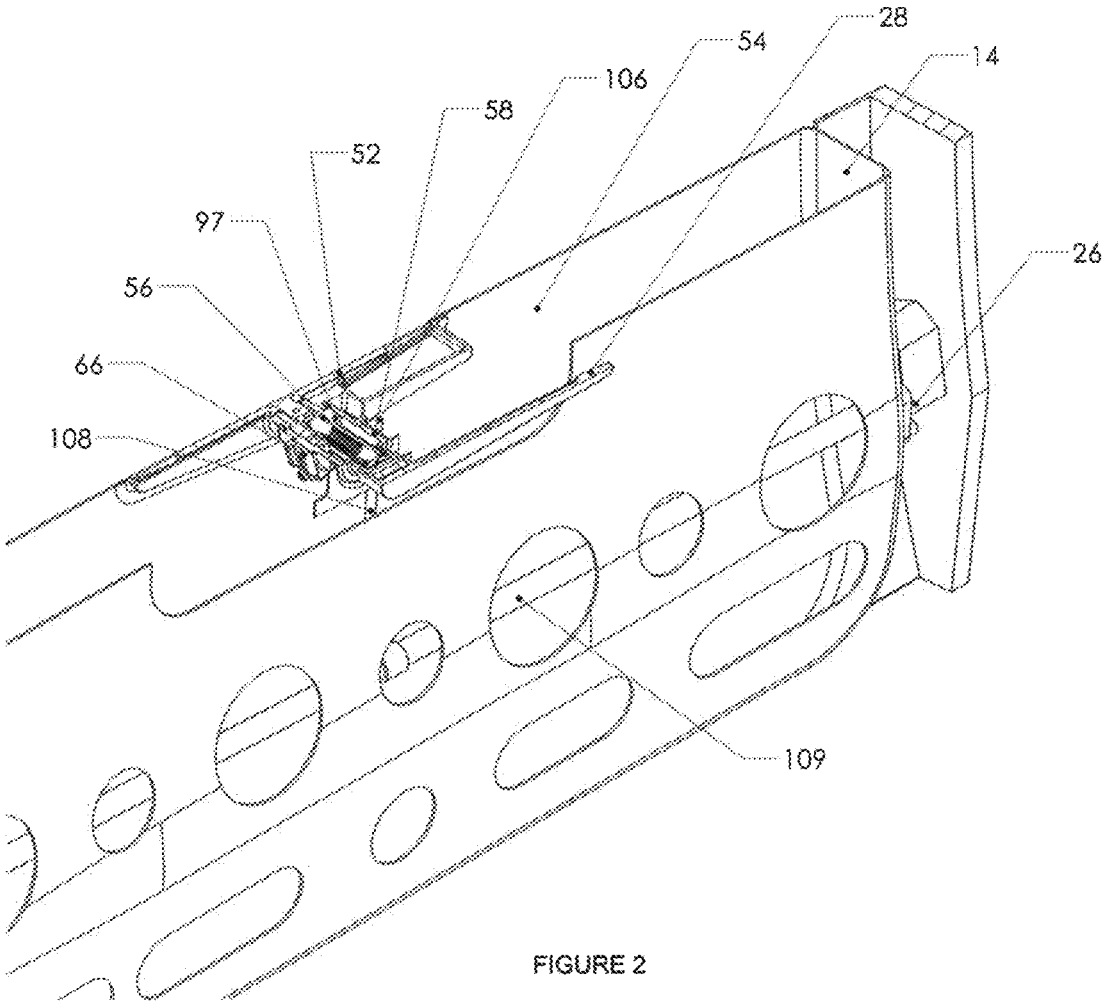
FIG. 2 is a perspective view in partial cutaway showing the handle assembly of this invention installed into an aircraft door when viewed from the inside.
Figure 3:
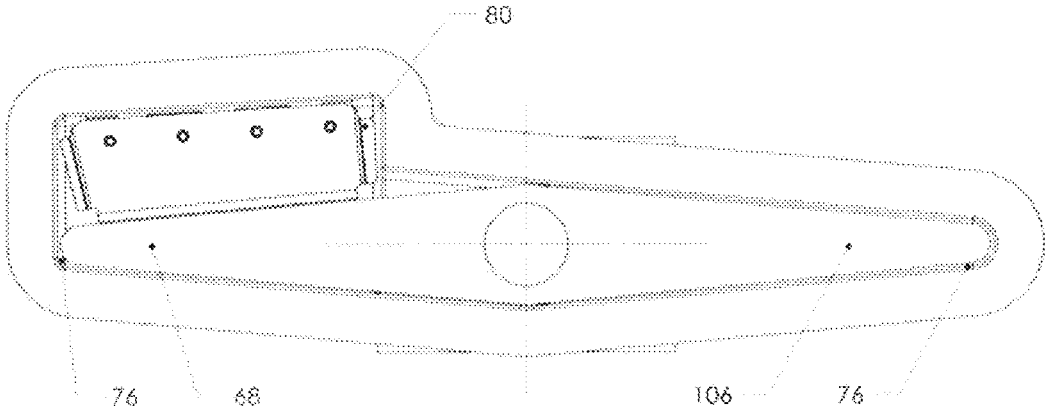
FIG. 3 is a top view of the handle assembly as viewed if installed to the aircraft door looking from the outside of the door.
Figure 4:
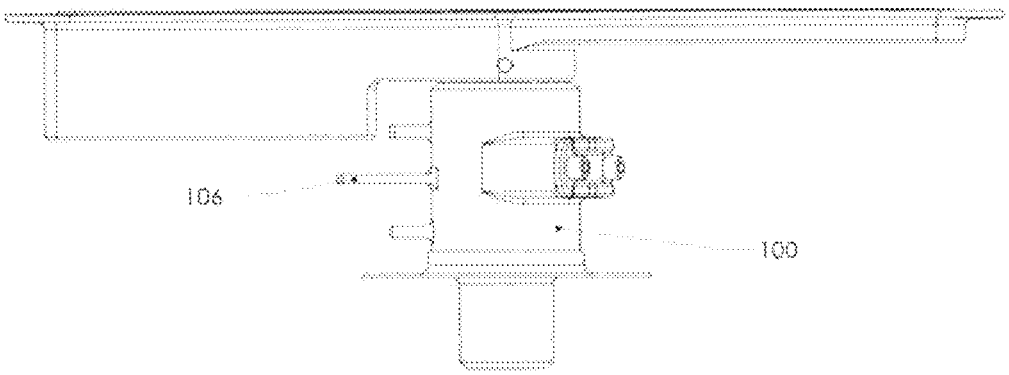
FIG. 4 is a side view of the handle assembly which can be derived as the front view of FIG. 3.
Figure 5:
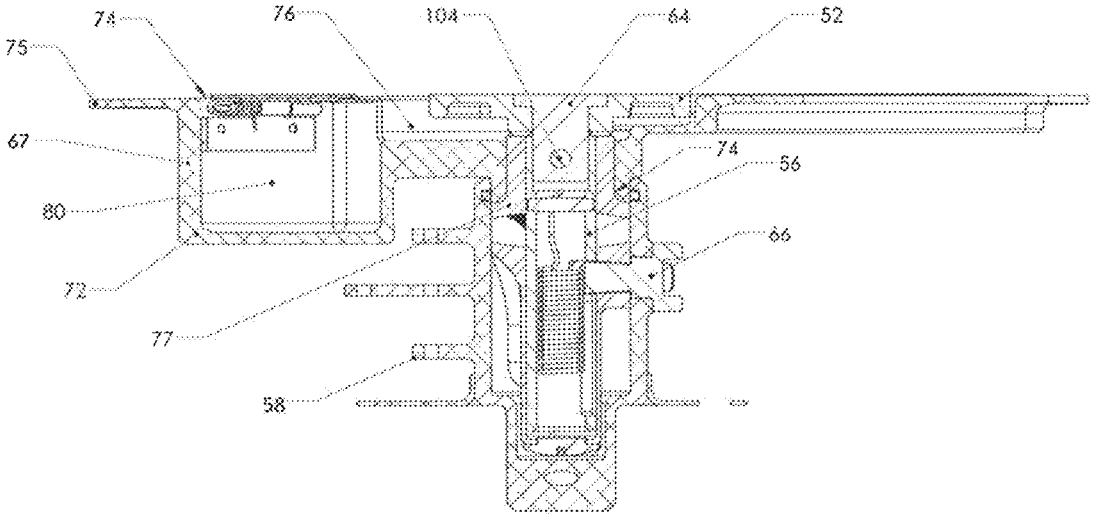
FIG. 5 is a cross-sectional view of the aircraft door assembly of this invention illustrating the view noted in FIG. 3 when the outside handle is stored and the stop pin fitting is in the axial slot of the inner shaft.
Figure 6:
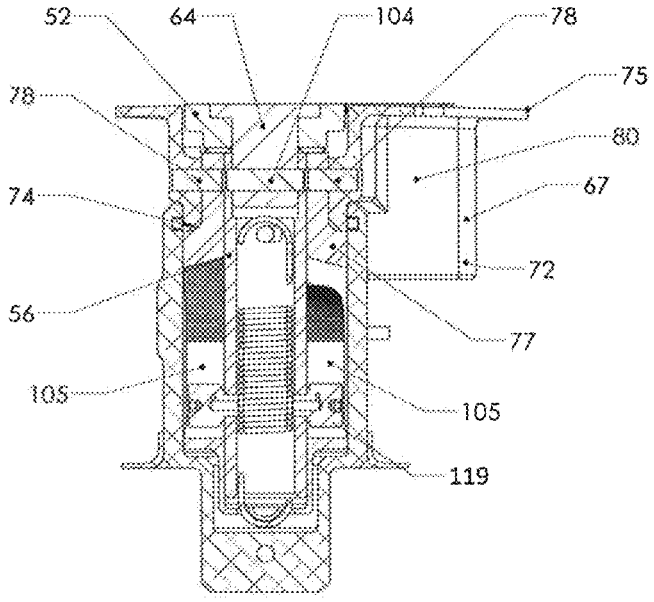
FIG. 6 is a cross-sectional view of the aircraft door assembly of this invention illustrating the view noted in FIG. 4 when the outside handle is stored and the inner shaft pins with integral bearing are at the retracted position in the curved grooves of the central intermediate shaft.

As depicted in FIG. 2, the handle assembly 12 of this invention includes outside handle 52 that is normally seated flush with outer skin 54 of the aircraft door 14. The outside handle 52 is also referred to as the external handle 52 or the exterior handle 52. An inner shaft 56 that extends through the door 14 is attached to the outside handle 52. The inner shaft 56 is fully covered by a cylindrical part of the housing body 77. The cylindrical part of the housing body 77 is covered by an outer shaft 58 to which both the inside handle 28, and the cam and track mechanism 26 are connected. The outer shaft 58 is fixed in place, it can rotate but it cannot move axially. The inner shaft 56 is fixed to rotate with the outside handle and telescopes, or extends, axially from the outer shaft 58 when the outside handle is pulled away from the aircraft door 14. A stop pin 66 is attached to the outer shaft 58 and passes through an axial slot in the inner shaft 56 so that both shafts will rotate in unison. The amount of rotation and the amount of axial extension of the exterior handle 52 before rotation can occur is controlled by the interaction of pin shafts 119 that are attached to the inner shaft 56 with each pin having integral bearings that are in contact with the curved slots in the cylindrical housing body 77 that is nestled between the outer shaft 58 and inner shaft 56. (See also FIGS. 5-7 and 8*a*-8*c*)

The outside handle 52, as depicted in FIGS. 2-7, is formed out of an integral piece of material and has a center hub 64 to which the inner shaft 56 is secured by a solid pin 104. In the event the outside handle 52 becomes extended while in Flight, the inner shaft 56 axial slot and outer shaft stop pin 66 stabilizes the handle relative to the surrounding airflow so as to prevent its rotation. The outside handle 52 is normally seated in a handle pan feature 72 of the handle housing body 67 that is mounted to the outside of the aircraft door 14 Flush with the outer skin 54. The handle housing body 67 is formed with an opening 74 through which a central intermediate supporting shaft 77 with two curved slots 105 is mounted to it by two solid stop pins 78. The inner shaft 56 is fully covered by the central supporting shaft 77. The outer shaft 58 fully covers the central supporting shaft and extends into the aircraft fuselage 18. The handle pan opening 74 is defined by an outwardly extending cylindrical lip 75. The handle pan 72 defines a pair of recesses 76, one shown, in which the handle blades 106 and 68 are seated so that the handle 52 is flush with the outer skin 54 of the aircraft door 14. A hand access pocket 80 is also formed in the handle pan 72 inside of and adjacent to one of the recesses 76 in which the handle blade 68 is normally seated. The hand access pocket 80 is dimensioned to allow an individual outside the aircraft to reach in and pull the handle blade 68 outwards so the handle 52 can be used to actuate the cam and track mechanism 26.

The outer shaft 58 is formed from an integral section of metal and has a main body 100 in the form of an open ended cylinder. The inside surface of the outer shaft rotates on the outer surface of the central supporting shaft 77. The outer shaft. 58 is formed with three circumferential flange tangs 106 extending away from the main body 100. The central flange 106 attaches to a pull-rod 108 that acts directly on a shaft 109 that is attached to the roller cam and track mechanism 26 that opens and closes the door.

General Description of Operation and the Illustrative Parts List for the First Embodiment of the Invention

1. General Description

The Flush Door Latch Assembly is used to secure a hinged aircraft access door. The assembly comprises a spring-loaded outer handle assembly, an actuator, and housing. (See FIGS. 5-7 and 8*a*-8*c*) The actuator is provisioned to accept an internal handle typically provided by the end user. The internal handle is also referred to as the interior handle or inside handle in this application. The internal handle is fixed in the actuator, and the external handle assembly is in the retracted position in the housing pan. The housing pan includes a hinged door assembly, also referred to as an aerodynamic flapper to provide access to the retracted outer handle assembly.

Refer to Table 1 for the Technical Properties of the Flush Door Latch Assembly.

Figure 7:
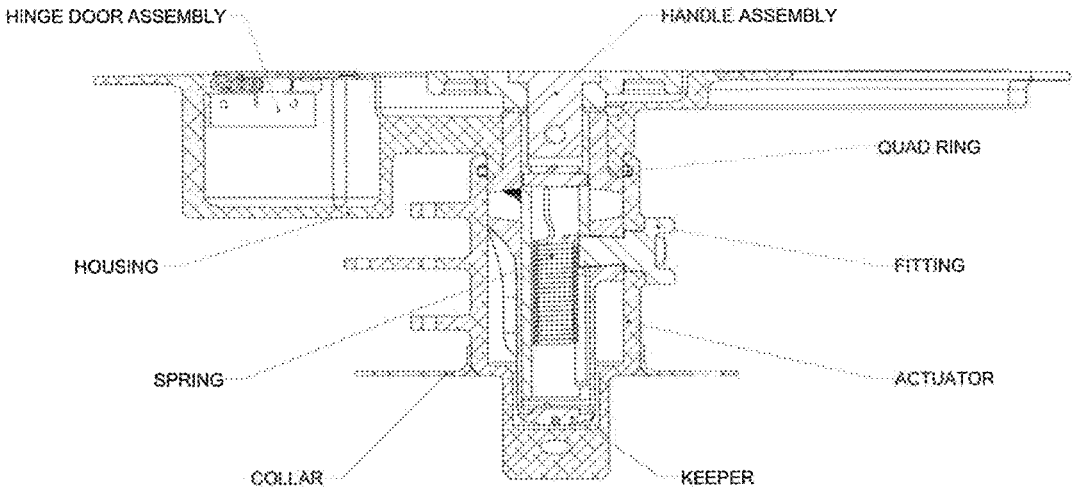
FIG. 7 illustrates a cross section view of the handle assembly.

See FIG. 7 for a Cross Section View of the Flush Door Latch Assembly.

a. Operation

Rotation of either the inner or outer handle causes a corresponding rotation of the actuator. When the actuator is in the closed position, the spring-loaded handle is stowed flush with the housing. With the outside handle in the stowed position, the inside handle may be rotated to actuate the latch assembly.

TABLE 1

Technical Properties

| Property | Specification |
|---|---|
| Length | 18 Inches (457 mm) |
| Width | 4.5 Inches (114.3 mm) |
| Depth/Thickness | 5.9 Inches (149.9 mm) |
| Outer Handle Extension (from stowed to open) | 1.5 to 1.7 Inches (38.1 to 43.2 mm) |
| Outer Handle Rotation (from stowed to open) | 46 Degrees |
| Weight | 5.0 lbs (2.2 kg) |

Procedures for assembly are listed below.

A. Apply Loctite to mating surfaces of top hat plug and external handle.
B. Install top hat plug through external handle and install the handle stop pad over the protruding end of the top hat plug.
C. Apply wet zinc-chromate primer or corrosion preventative compound to the surface of the protruding end of the top hat plug and to the surface of the top hat pin.
D. Align the mount holes in the top hat plug and the external handle shaft then press the top hat pin into the top hat plug and the external handle shaft while the primer is still wet.
E. Insert the new spring into the external handle shaft.
F. Apply wet zinc-chromate primer or corrosion preventative compound to the surface of the handle return spring pin.
G. Press the pin into the external handle shaft to retain the spring while the primer is still wet.
H. Apply wet zinc-chromate primer or corrosion preventative compound to the surfaces of the two housing body to housing shaft pins.
I. Align the mount holes in the housing body and the housing shaft then press the housing body to housing shaft pins into the housing body and the housing shaft while the primer is still wet.
J. Install the hinge door assembly flap to the hinge assembly with four BACR15CE3 rivets.
K. Install the hinge assembly to the housing body with four BACR15CE3 rivets.
L. Install the external handle shaft into the housing shaft.
M. Extend the handle return spring from the housing shaft and install the return spring keeper.
N. Apply Loctite to the threads of the cam-followers and install them through the J-slots of the housing shaft into the external handle shaft with 40 to 45 in-lbs (54.2 to 61.0 N-m) of torque to secure the cam-followers to the external handle shaft.
O. Install the new quad ring into the actuator.
P. Lubricate the mating surfaces of the actuator and the housing shaft with grease.
Q. Place the actuator over the housing shaft.
R. Align the hole in the actuator with the slot in the housing shaft and install the actuator stop pin.
S. Apply wet zinc chromate primer or corrosion preventative compound to the threads of the actuator stop pin screws. Install the screws while the primer is wet.
T. For countersunk head screws; use a torque wrench and install the two screws with 40 to 45 in-lbs (54.2 to 61.0 N-m) of torque to secure the actuator fitting to the actuator,
U. Install the collar over the actuator.

2. Illustrative Parts List (IPL) for FIGS. 8*a*-8*c*

The Illustrative Parts List is divided into 6 columns. The information supplied in each column is given below.

A. FIG. ITEM Column (1) The first number at the top of each FIG. ITEM column is the figure number of the related exploded-view IPL illustration. The number given opposite each part number is the item number given to the part in the illustration.

(2) A dash (-) is put in front of an item number when the part is not illustrated.

(3) Alpha-variants A through Z (except for I and O) are given to item numbers when necessary to identify added parts, alternative parts and parts added, deleted, modified or superseded by a service bulletin or letter.

B. PART NUMBER Column (1) This column contains the manufacturer's parts number for each part, as modified to meet the requirements of ATA Specification 200/2000. The modifications can include:

(a) Removal of blank spaces and special characters.

(b) Removal of dashes. Dashes are permitted only between numeric characters.

(2) A reference part number compatible with ATA Specification 200/2000 is given if the manufacturer's part number exceeds 15 characters. The complete manufacturer's part number is given in the NOMENCLATURE column.

(3) The basic part number is given in the PART NUMBER Column and may be followed by an alpha suffix (115A) for identification purposes. This is done to comply with the ATA Provisioning Data file edit requirements.

(4) The complete part number is given in the NOMENCLATURE column (FULL P/N 115-094-1400). This is the part number to be used to order replacement parts.

C. Material Description Column

This column identifies the base material from which the component is manufactured.

D. Nomenclature Column (1) This column contains descriptive nomenclature for each component. It also gives details of the relationship of the assemblies, subassemblies and detail parts and any applicable history information.

(2) The indenture system used in the NOMENCLATURE column shows how one part is related to one more as follows:

'1 2 3 4 5 6 7

End Item or Major Assembly

*ATTACHING PARTS*

Attaching Parts for End Item or Major Assembly

* * * * * * * * * * * * *

.Sub-Assembly of End Item or Major Assembly

..Detail parts of Sub-Assembly (3) Attaching Parts are listed immediately following the item which they attach. They are preceded by the phrase "*ATTACHING PARTS*" and are followed by the symbol "* * * * * * * * * * *"

(4) The basic part number is given in the PART NUMBER Column and may be followed by an alpha suffix (115A) for identification purposes. This is done to comply with the MA Specification 200/2000 Provisioning Data file edit requirements. The complete part number is given in the NOMENCLATURE column (FULL P/N 115-094-1400). This is the part number to be used to order replacement parts.

(5) Assemblies, subassemblies and detail parts applicable to modifications, deletions, additions or replacement by an issued service bulletin or service letter are given to show both pre- and post-service bulletin/letter (SB/SL) configuration.

(a) The term (PRE-SB/SL) in the NOMENCLATURE column gives the first configuration.

(b) The term (POST-SB/SL) identifies assemblies and parts after the modification has been completed.

(6) The interchangeability relationship between parts is identified in the NOMENCLATURE column of the Detail Parts List.

Illustrative Parts List (IPL) for FIGS. 8*a*-8*c*

| FIG. ITEM IPL 1A | PART NUMBER | AIRLINE STOCK NO. | NOMENCLATURE 1 2 3 4 5 6 | EFF CODE | UNITS PER ASSY |
|---|---|---|---|---|---|
| 1 | 718411-201-001 | | TOP HAT PLUG | A | 1 |
| 2 | 718411-202-000 | | EXTERNAL HANDLE | A | 1 |
| 3 | 718411-203-001 | | STOP PAD | A | 1 |
| 4 | 718411-204-000 | | TOP HAT PIN | A | 1 |
| 5 | 718411-205-000 | | EXTERNAL HANDLE SHAFT | A | 1 |
| 6 | 718411-206-001 | | CAM FOLLOWER | A | 2 |
| 7 | 718411-207-001 | | HANDLE RETURN SPRING PIN | A | 1 |
| 8 | 718411-208-000 | | HANDLE RETURN SPRING | A | 1 |
| 9 | 718411-209-000 | | RETURN SPRING KEEPER | A | 1 |
| 10 | 718411-301-001 | | HINGE DOOR ASSEMBLY | A | 1 |
| 11 | 718411-302-002 | | HINGE DOOR FLAP RIVET | A | 4 |
| 12 | 718411-303-001 | | HINGE ASSEMBLY | A | 1 |
| 13 | 718411-304-000 | | HINGE DOOR HOUSING RIVET | A | 4 |
| 14 | 718411-305-000 | | HOUSING BODY | A | 1 |
| 15 | 718411-306-000 | | HOUSING SHAFT PIN | A | 2 |
| 16 | 718411-307-000 | | HOUSING SHAFT | A | 1 |
| 17 | 718411-401-000 | | QUADRING | A | 1 |
| 18 | 718411-402-000 | | ACTUATOR | A | 1 |
| 19 | 718411-403-000 | | STOP PIN | A | 1 |
| 20 | 718411-404-000 | | CAP SCREWS | A | 2 |
| 21 | 718411-405-000 | | COLLAR | A | 1 |

Detailed Description of the Second Embodiment of the Invention

FIG. 9 is a perspective view of an aircraft door assembly 14 to which one preferred embodiment of a handle assembly 28 of this invention is attached. The door assembly 14 includes a door 14 fitted into an opening 16 formed inside an aircraft fuselage 18. A hinge 20 connects the door 14 to the inside of the fuselage 18 so that the door can move between open and closed positions. The sides of the door 14 are provided with a number of outwardly extending door stops 22, and the fuselage 18 is provided with a number of flanges 24 that project into the opening 16 adjacent the door stops. When the aircraft is in flight, high cabin pressure inside the fuselage 18, in comparison to lower atmospheric pressure urges the door 14 outwards so that door stops 22 abut the fuselage flanges 24 and seal the door shut. The opening and closing of the door 14 is controlled by a roller cam and track mechanism 26. When the door 14 is closed, the roller cam and track mechanism 26 controls the travel of the door so that the door stops 22 move into a position slightly below and in front of the fuselage flanges 24. After the door stops are adjacent to the fuselage flanges 24, the roller cam and track mechanism pulls the door 14 outwards towards the aircraft fuselage 18 so that the door stops on the fuselage stops. When the door 14 is opened, the roller cam and track mechanism 26 first lifts the door upwards slightly and inwards so that the door stops 22 clear the fuselage flanges 24 so that in turn, the door 16 can be moved upwards to the full open position. The upwards movement of the door 14 to its open position is assisted by a spring loaded counterbalance mechanism that pulls the door upwards. The actuation of the roller earn and track mechanism 26 is controlled by the handle assembly 12 as will be described hereinafter. The handle assembly 12 is provisioned to accept the attachment of an inside handle 9 so that actuation of the roller cam and track mechanism 26 and the opening and closing of the aircraft door 14 can be controlled from inside the aircraft.

As depicted in FIGS. 10 thru 13 the handle assembly of this invention includes an external handle 3 that is normally seated flush with the outer skin 30 of the aircraft door 14 when the door handle assembly is in the stowed position. The External handle 3 is also referred to as the outside handle 3 or the exterior handle 3. An inner Shaft 4 is housed by the shaft housing 2. The shaft housing 2 is housed by the actuator housing 17. The exterior handle 3 is fixed to the inner shaft 4 using a solid pin 32. The actuator housing 17 is fixed to the interior handle 9 by a bolt and nut assembly 10. The interior handle is also referred to as the internal handle 9 or the inside handle 9. The in The actuator housing 17 is supported by two ball bearing assemblies 5 and 11. The inner race of the ball bearing assembly 5 is supported by the shaft housing 2. The outer race of the ball bearing assembly 5 provides support to the actuator housing 17. The inner race of the ball bearing assembly 11 is supported by the shaft housing 2. The outer race of the ball bearing assembly 11 provides support to the actuator housing 17. By supporting the actuator with the use of ball bearing assemblies 5 and 11, it allows for smooth and precise rotation about the axis of all cylindrical parts which include the inner shaft 4, the shaft housing 2, and the actuator housing 17. An additional ball bearing assembly 21 is utilized to support the actuator housing 17 which in turn provides a secondary means of support to the shaft housing 2. The primary support for the shaft housing is provided by the handle housing 1. The shaft housing 2 is fixed to the handle housing 1 by utilizing a retaining nut 7. The cam follower pin 8 passes through the shaft housing 2, the inner shaft 4 and the spring keeper 15. The cam follower 8 limits the amount of travel the inner shaft 4 in both the axial and the rotational direction because the cam follower 8 is only free to rotate and translate within a specified slot cut through the shaft housing 2. The cam follower 8 is also confined to an internal pathways cut into the inner surface of the actuator housing 17. The external handle return spring 25 is attached to the spring keeper 15 by engaging the spring coils over a specified thread cut into the spring keeper 15. The spring retainer 13 is supported by the shaft housing 2. The spring 25 is attached to the spring retainer 13 by engaging the spring coils over a specified thread cut into the spring retainer 13. The shaft housing 2 supports a seal 19 to ensure fuselage cabin pressure does not escape. The actuator housing 17 supports a second seal 6 to ensure fuselage cabin pressure does not escape.

Figure 14A:
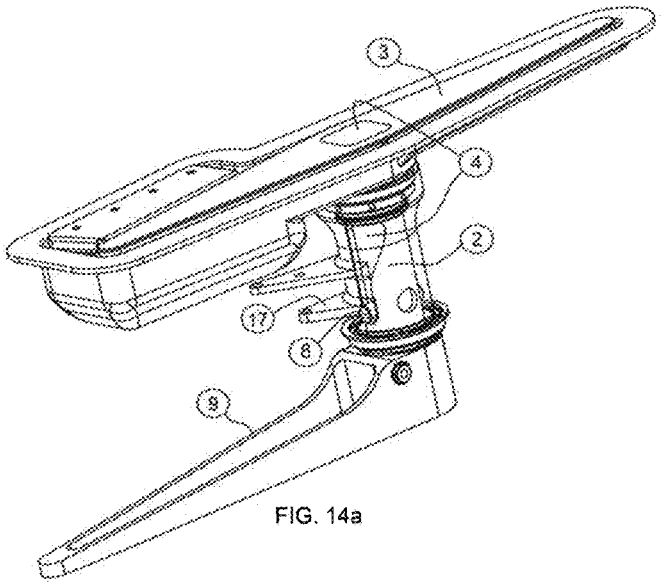
FIG. 14*a* illustrates a perspective view showing the components in the extended and stowed positions.
Figure 14B:
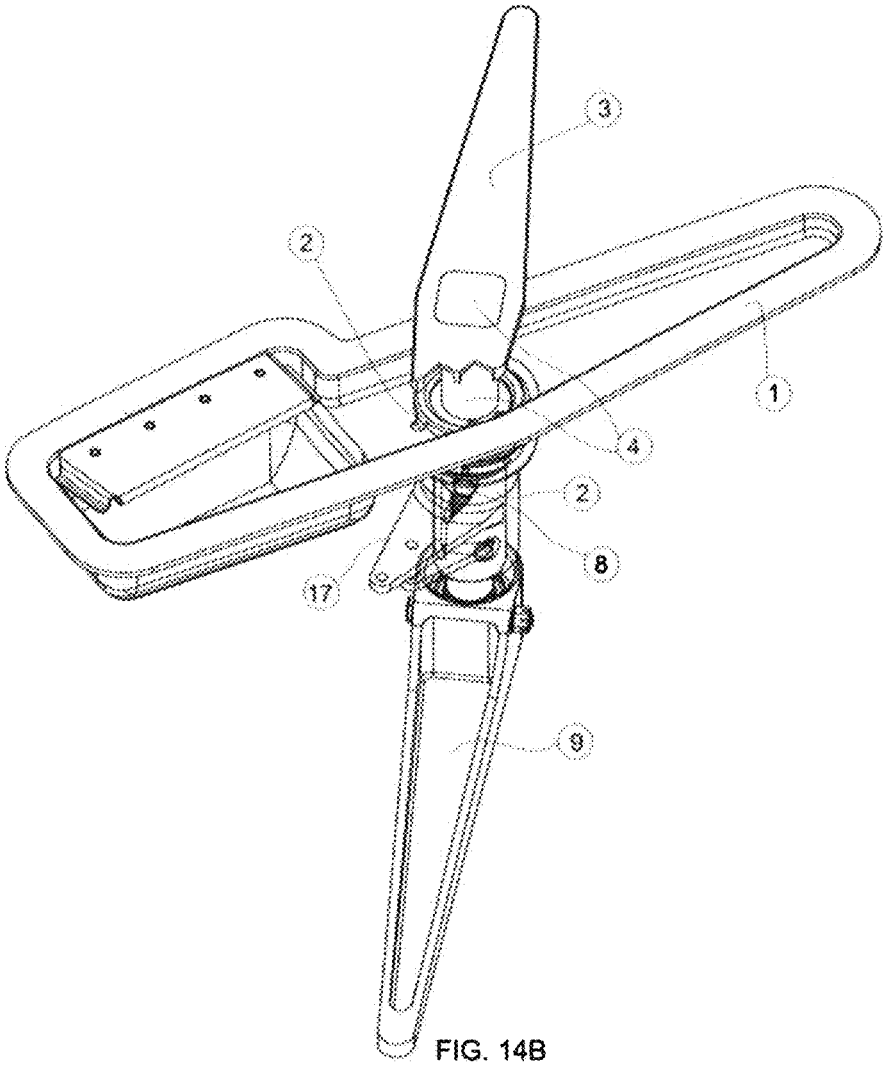
FIG. 14*b* illustrates another perspective view showing the components in the extended and stowed positions.

As described in FIGS. 14*a* and 14*b* the shaft housing 2 has specified geometry cut through the cylinder walls that provides a means of limiting the travel of the cam follower pin 8. When the external handle 3 is in the stowed position (shown FIG. 15) the cam follower 8 is limited to only axial movement by the shaft housing 2. Even though the external handle 3 is in the stowed position the cam follower 8 is partially disengaged from the actuator housing 17 which allows the internal handle 9 to rotate a specified amount in one direction. The stowed position is the normal position that the handle assembly is in due to the constant spring pressure provided by the external handle return spring 25 regardless of the door 14 being in the open or closed position. As the external handle 3 is extended outward by an operator the cam follower pin 8 travels axially engaging the axial pathway cut into the actuator housing 17. Once the cam follower pin 8 travels a specified distance it partially disengages the shaft housing 2 and remains fully engaged to the actuator housing 17 allowing a mechanical connection between the external handle 3 and the actuator housing 17. Upon full extension of the external handle 3 the cam follower pin 8 allows the inner shaft 4 to rotate freely within a specified range. By allowing the inner shaft 4 to rotate freely within the limits of the shaft housing 2 this allows the operator to actuate the door linkage 29 as needed. The operator can let go of the external handle 3 in any range of extension and rotation and the external handle will automatically return its-self back to the stowed position (including the clocking position of the external handle 3) without contacting the handle housing 1 or the aircraft door skin 30. Returning the external handle 3 to the stowed position is controlled by a combination of the external handle return spring 25 providing spring pressure and the cam follower pin 8 following the slot geometry of the shaft housing 2.

General Description of Operation and the Illustrative Parts List for the Second Embodiment of the Invention

1. General Description of Operation

The Flush Door Latch Assembly is used as the mechanical means to open, close, and secure a hinged aircraft access door. The assembly consists of a spring-loaded exterior handle assembly, an actuator, a housing pan, and an internal handle. The internal handle is fixed to the actuator, and the exterior handle engages the actuator when it is extended by the operator. The external handle disengages the actuator and automatically re-stows its self when the operator releases the exterior handle. The external handle is also referred to as the outside handle or the exterior handle.

Refer to Table 2 for the Technical Properties of the Flush Door Latch Assembly for the second embodiment.

See FIGS. 15*a*-15*b* for the Primary Components of the Hush Door Latch Assembly for the second embodiment.

See FIG. 16 for a Cross Section View of the Flush Door Latch Assembly.

a. Operation

Rotation of either the inner or outer handle causes a corresponding rotation of the actuator. When the actuator is in the closed or retracted position, the spring loaded exterior handle is stowed flush with the housing pan. With the exterior handle in the stowed position the interior handle may be rotated to actuate the latch assembly.

TABLE 2

Technical Properties For The Second Embodiment

| Property | Specification |
|---|---|
| Length | 18.3 Inches (464.82 mm) |
| Width | 4.6 Inches (118.36 mm) |
| Depth/Thickness | 6.1 Inches (154.94 mm) |
| Exterior Handle Extension (from stowed to open) | 1.5 to 1.7 Inches (38.1 to 43.2 mm) |
| Exterior Handle Rotation (from extended to full rotation) | 46 Degrees min 48 Degrees max |
| Weight | 4.0 lbs (1.8 kg) |

2. Illustrative Parts List (IPL) for FIGS. 17*a*-17*d*

The Illustrative Parts List (IPL) is divided into 6 columns. The information supplied in each column is given below:

A. FIG. ITEM Column (1) The first number at the top of each FIG. ITEM column is the figure number of the related exploded-view IPL illustration. The number given opposite each part number is the item number given to the part in the illustration.

(2) A dash (-) is put in front of an item number when the part is not illustrated.

(3) Alpha-variants A through Z (except for I and O) are given to item numbers when necessary to identify added parts, alternative parts and parts added, deleted, modified or superseded by a service bulletin or letter.

B. PART NUMBER Column (1) This column contains the manufacturer's parts number for each part, as modified to meet the requirements of ATA Specification 200/2000. The modifications can include:

(a) Removal of blank spaces and special characters.

(b) Removal of dashes. Dashes are permitted only between numeric characters.

(2) A reference part number compatible with ATA Specification 200/2000 is given if the manufacturer's part number exceeds 15 characters. The complete manufacturer's part number is given in the NOMENCLATURE column.

(3) The basic part number is given in the PART NUMBER Column and may be followed by an alpha suffix (115A) for identification purposes. This is done to comply with the ATA Provisioning Data file edit requirements.

(4) The complete part number is given in the NOMENCLATURE column (FULL P/N 115-094-1400). This is the part number to be used to order replacement parts.

C. MATERIAL DESCRIPTION Column

This column identifies the base material from which the component is manufactured.

D. NOMENCLATURE Column (1) This column contains descriptive nomenclature for each component. It also gives details of the relationship of the assemblies, subassemblies and detail parts and any applicable history information.

(2) The indenture system used in the NOMENCLATURE column shows how one part is related to one more as follows:

'1 2 3 4 5 6 7

End Item or Major Assembly

*ATTACHING PARTS*

Attaching Parts for End Item or Major Assembly

* * * * * * * * * * * * *

. Sub-Assembly of End Item or Major Assembly

. . Detail parts of Sub-Assembly (3) Attaching Parts are listed immediately following the item Which they attach. They are preceded by the phrase "*ATTACHING PARTS*" and are followed by the symbol "* * * * * * * * * * * *".

(4) The basic part number is given in the PART NUMBER Column and may be followed by an alpha suffix (115A) for identification purposes. This is done to comply with the ATA Specification 200/2000 Provisioning Data file edit requirements. The complete part number is given in the NOMENCLATURE column (FULL P/N 115-094-1400). This is the part number to be used to order replacement parts.

(5) Assemblies, subassemblies and detail parts applicable to modifications, deletions, additions or replacement by an issued service bulletin or service letter are given to show both pre- and post-service bulletin/letter (SB/SL) configuration, (a) The term (PRE-SB/SL) in the NOMENCLATURE column gives the first configuration.

(b) The term (POST-SB/SL) identifies assemblies and parts after the modification has been completed.

(6) The interchangeability relationship between parts is identified in the NOMENCLATURE column of the Detail Parts List.

| FIG. ITEM IPL 1A | PART NUMBER | AIRLINE STOCK No. | NOMENCLATURE 123456 | EFF CODE | UNITS PER ASSY |
|---|---|---|---|---|---|
| 1 | 718932-100-329 | | HOUSING, DOOR HANDLE | A | 1 |
| 2 | 718932-100-311 | | CAM RAIL, SHAFT HOUSING | A | 1 |
| 3 | 718932-100-313 | | STOPPER, RING | A | 1 |
| 4 | MS16625-1137 | | SNAP RING | A | 1 |
| 5 | 718932-100-315 | | NUT, RETAINING | A | 1 |
| 6 | BACB10FU25JZ | | BEARING | | 1 |
| 7 | SLS-A-125-N-70 | | QUAD RING SEAL | | 1 |
| 8 | 718932-100-303 | | HANDLE, INTERNAL | A | 1 |
| 9 | SLS-A-125-N-70 | | QUAD RING SEAL | | 1 |
| 10 | 718932-100-301 | | HOUSING, ACTUATOR | A | 1 |
| 11 | BACB30NMK26 | | BOLT | | 1 |
| 12 | NAS1149D0332J | | WASHER | | 2 |
| 13 | BACN10JD3CD | | NUT | | 1 |
| 14 | BACB10FU12J | | BEARING | | 1 |
| 15 | MS16625-1118 | | SNAP RING | | 1 |
| 16 | 718932-100-333 | | COVER, HINGE | A | 1 |
| 17 | 718932-100-319 | | PIN, EXTERNAL HANDLE | A | 1 |

-continued

| FIG. ITEM IPL 1A | PART NUMBER | AIRLINE STOCK No. | NOMENCLATURE 123456 | EFF CODE | UNITS PER ASSY |
|---|---|---|---|---|---|
| 18 | 718932-100-317 | | SHAFT, EXTERNAL HANDLE | A | 1 |
| 19 | 718932-100-323 | | RECEIVER, SPRING | A | 1 |
| 20 | AE059-613-21.00-17-7-1.298-NH-N-IN | | RETURN SPRING | | 1 |
| 21 | 718932-100-321 | | HANDLE, EXTERNAL | A | 1 |
| 22 | 718932-100-325 | | PIN, CAM FOLLOWER | A | 1 |
| 23 | 718932-100-305 | | PLATE BEARING SUPPORT | A | 1 |
| 24 | BACB10FU25JZ | | BEARING | | 1 |
| 25 | MS16625-1200 | | SNAP RING | | 1 |
| 26 | 718932-100-327 | | KEEPER, SRING RETURN | A | 1 |
| 27 | MS16624-1075 | | SNAP RING | | 1 |
| 28 | 103689-1 | | SPRING | | 1 |
| 29 | 718932-100-701 | | HINGE | | 1 |
| 30 | 718932-100-701 | | HINGE | | 1 |
| 31 | 718932-100-701 | | HINGE PIN | | 1 |
| 32 | BACR15CE3D | | SOLID FLUSH RIVETS | | 4 |
| 33 | BACR15CE3D | | SOLID RIVETS | | 4 |

Illustrative Parts List (IPL) for FIGS. 17*a*-17*d*

3. Procedures

NOTE: Numbers in parenthesis refer to IPL Figure item numbers.

A. Install aerodynamic flapper gate assembly (16) to the handle housing (1). Use solid rivets as the attaching hardware 33.

B. Apply sealant to faying surfaces of the external handle shaft and external handle (21).

C. Install external handle shaft (18) through external handle (21) and Apply wet zinc chromate primer to the external handle pin (17) and install through both the shaft (18) and the handle (21).

D. Thread the return spring (20) onto the spring receiver (19) ensure that 3 coils of the spring are engaged onto the threads of the receiver. Set aside for later assembly.

E. Apply sealant to the cam rail (2) and install through the handle housing (1), ensure that the clocking key is aligned. Wipe away any excess sealant and install bearing (6) onto the cam rail (2). Apply sealant to retaining nut threads (5) and install over bearing (6) tighten to 32-60 foot pounds. Place the stop pad (3) on to the cam rail and install the snap ring (4) to lock it in place.

F. Take the previously assembled receiver and spring (19 and 20) and place in the open end of the external handle shaft (18) receiver end into the handle first so that the spring is sticking out. Slide the external handle assembly (17,18,19,20 and 21) through the previously assembled housing and cam rail (1,2). Using a tapered aligning tool align the spring receiver (19) to the external handle shaft (18) so that the cam follower (22) can slide through the open slot in the cam rail (2). Set assembly aside for later assembly.

G. Slide the bearing (14) into the actuator housing (10) until it is seated. Using long nose snap ring pliers install the snap ring (15) into the actuator housing (10) to trap the bearing (14) between the snap ring (15) and the bearing seat. Install the seal (9) onto the outer diameter of the actuator (10) so that it is seated into the seal groove.

H. Install the actuator (10) and the previously installed bearing (14) and snap ring (15) onto the previously assembled cam rail (2), and the handle housing (1). Orientate the actuator (10) so that the actuator linkage attach flanges are on the same side as the aircraft linkage. Slide the actuator (10) onto the cam rail (2) align the cam follower (22) so it is aligned with the vertical keyway slot on the inside surface of the actuator (10). Slide the actuator (10) all the way until it seats and the snap ring groove on the cam rail (2) is exposed. Using snap ring pliers install the snap ring (27) to lock the actuator (10) into place. Thread the return spring (20) over the spring retainer (26) ensure 3 coils are engaged.

I. Install bearing (24) into bearing support collar (23) and using snap ring pliers install snap ring (25) to secure bearing. Slide collar assembly over actuator (10). Slide internal handle (8) over actuator (10) align bolt hole and install bolts (11) with washer (12) under head. Install washer (12) under nut (13.

It should be understood that the foregoing relates to exemplary embodiments of the invention and that modifications may be made without departing from the spirit and scope of the invention. It should also be understood that the present invention is not limited to the designs mentioned in this application and the equivalent designs in this description, but it is also intended to cover other equivalents now known to those skilled in the art, or those equivalents which may become known to those skilled in the art in the future. For example, alternative embodiments of the invention may be desirable to provide an outer shaft at a variable axial position in the aircraft fuselage 18, and an inner shaft attached to the outside handle that telescopes outwards when the outside handle is extended. Specific subassemblies of components of this invention similarly may differ widely from what has been described. For instance, in some embodiments of the invention it may be desirable to form the handle housing body and cylindrical intermediate supporting shaft as a single piece. Moreover, it should be clear that the invention can be practiced without all the disclosed features of the described embodiment. For example, in some versions of the invention it may not be necessary to provide the interior handle box 28.

What is claimed is:

1. A flush door latch assembly for opening and closing an aircraft access door, said door having an exterior side and an interior side, and said door is adapted to have a rotatable interior handle and a rotatable exterior handle, said latch assembly comprising:

an actuator comprising an outer shaft, the outer shaft having an axis of rotation and fixedly connected to a rotatable interior handle, the actuator further comprising a cam follower adapted for controlling the door latch assembly in order to open and close the aircraft access door via a roller cam and track mechanism;

a rotatable exterior handle, fixedly connected to an inner shaft coaxially disposed within the outer shaft of the actuator the inner shaft having a cam follower pin and an extended position and a retracted position, the inner shaft being maintained in the retracted position by a spring; and a housing pan, disposed around the rotatable exterior handle and fixedly mounted to the aircraft access door, and having a recess to receive and stow the rotatable exterior handle flush with the exterior side of the access door when the inner shaft is in the retracted position; and an intermediate shaft fixedly connected to the housing pan and coaxially disposed between the outer and inner shafts, the intermediate shaft having a slot to form a cam lobe profile engaged with the cam follower pin as the inner shaft transitions between the retracted position and the extended position, the cam follower pin being guided by the cam lobe profile as the inner shaft is rotated while in the extended position to engage the cam follower in order to open and close the aircraft access door.

2. The flush door latch assembly according to claim 1 wherein the cam lobe profile provides a straight portion parallel to the access of the intermediate shaft to prevent rotation of the actuator when the external handle is moving to its extended position.

3. The flush door latch assembly according to claim 1 wherein the cam lobe profile is shaped to controllably rotate the inner shaft in response to the travel of the cam follower pin along the cam lobe profile during actuation of the door latch assembly.

4. The flush door latch assembly according to claim 1 wherein the housing pan includes a deepened recess portion disposed below the exterior handle to provide operator access thereto.

5. The flush door latch assembly according to claim 1 wherein the exterior handle automatically retracts into the housing pan if released when the exterior handle is in the extended position.

6. The flush door latch assembly according to claim 4 further including an aerodynamic flapper disposed over the deepened recess portion of the housing pan.

* * * * *